US010373568B2

(12) United States Patent
Yamashita et al.

(10) Patent No.: US 10,373,568 B2
(45) Date of Patent: Aug. 6, 2019

(54) DISPLAY DEVICE

(71) Applicant: FUNAI ELECTRIC CO., LTD., Osaka (JP)

(72) Inventors: Hiroshi Yamashita, Akashi (JP); Tatsuya Kita, Kadoma (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 0 days.

(21) Appl. No.: 15/088,119

(22) Filed: Apr. 1, 2016

(65) Prior Publication Data

US 2016/0293115 A1 Oct. 6, 2016

(30) Foreign Application Priority Data

Apr. 2, 2015 (JP) ..... 2015-076247

(51) Int. Cl.

*G09G 3/34* (2006.01)
*H05B 33/08* (2006.01)
*G09G 3/36* (2006.01)

(52) U.S. Cl.

CPC ..... *G09G 3/3406* (2013.01); *G09G 3/342* (2013.01); *H05B 33/0815* (2013.01); *H05B 33/0845* (2013.01); *G09G 3/3611* (2013.01); *G09G 2310/024* (2013.01); *G09G 2310/0237* (2013.01); *G09G 2320/0252* (2013.01); *G09G 2320/0257* (2013.01); *G09G 2320/0261* (2013.01); *G09G 2320/064* (2013.01); *G09G 2320/0633* (2013.01); *G09G 2330/021* (2013.01); *G09G 2360/16* (2013.01)

(58) Field of Classification Search

CPC ..... G09G 3/3406; G09G 3/34; G09G 3/3413
See application file for complete search history.

(56) References Cited

U.S. PATENT DOCUMENTS

2008/0180385 A1* 7/2008 Yoshida ..... G09G 3/20 345/102
2009/0303161 A1* 12/2009 Messmer ..... G09G 3/14 345/55
2010/0214207 A1* 8/2010 Hosoki ..... G09G 3/3406 345/101
2011/0134023 A1* 6/2011 Feng ..... G09G 3/3406 345/102

(Continued)

FOREIGN PATENT DOCUMENTS

JP 2011232535 11/2011

*Primary Examiner* — Lixi C Simpson
(74) *Attorney, Agent, or Firm* — JCIPRNET

(57) ABSTRACT

A liquid crystal display device includes a liquid crystal panel, a backlight panel and a backlight drive circuit which outputs drive current of the backlights, the duty ratio and the amplitude of which are changeable. The backlight drive circuit outputs the drive current based on duty ratio characteristics that the duty ratio is greater as the luminance of the backlights is higher and amplitude characteristics that is divided with a predetermined luminance as a boundary into the first and second regions, and that the change rate of the amplitude of the drive current with respect to the luminance is less than or equal to the predetermined change rate in the first region, and the change rate of the amplitude of the drive current with respect to the luminance is greater than the predetermined change rate.

23 Claims, 17 Drawing Sheets

(56) References Cited

U.S. PATENT DOCUMENTS

| | | | | |
|---|---|---|---|---|
| 2012/0086701 | A1* | 4/2012 | Vaananen | H05B 33/0848 345/214 |
| 2014/0035960 | A1* | 2/2014 | You | G09G 3/3413 345/690 |
| 2014/0292634 | A1* | 10/2014 | Kita | G09G 3/342 345/102 |
| 2015/0116379 | A1* | 4/2015 | Lim | G09G 3/3406 345/691 |

* cited by examiner

DISPLAY DEVICE

CROSS-REFERENCE TO RELATED APPLICATION

This application claims the priority benefit of Japan application no. 2015-076247, filed on Apr. 2, 2015. The entirety of the above-mentioned patent application is hereby incorporated by reference herein and made a part of this specification.

FIELD OF THE INVENTION

The present invention relates to a display device and in particular to technology for driving a light source the display device includes.

BACKGROUND OF THE INVENTION

The liquid crystal display devices, such as liquid crystal televisions, have been increased in size. However, as the size increases, there exists a problem that fuzziness of the image (also referred to as "motion blur" hereinafter) is obvious when a motion video is displayed.

To suppress motion blur, a method performing backlight scanning has been known. The backlight scanning means sequentially pulse-lighting a plurality of backlights (light source) toward a group of liquid crystal pixels of the display panel in the line direction. In the present disclosure, an effect suppressing motion blur is shortly called a scan effect.

For such backlight scanning, technology to correct luminance dispersion of each backlight has been known (e.g. Patent Document 1).

Patent Document 1 describes that each backlight may be arbitrarily dimmed by supplying each backlight with a drive current that is pulse-width modulated based on a lighting duty ratio adjusted for individual backlight while the drive current remains constant.

Patent Document 1 also describes to select and use a combination from a number of combinations of the lighting duty ratio and the drive current (peak current) with which the average luminance of the screen is almost the same, according to the speed of the motion on the screen. Specifically, if the speed of the motion on the screen is fast, the scan effect is exhibited by using a substantially large peak current and adjusting the luminance within a range of small lighting duty ratios, and if the speed of the motion on the screen is slow, the luminous efficiency is improved by using a substantially small peak current and adjusting the luminance within a range of large lighting duty ratios.

PRIOR ART DOCUMENTS

Patent Documents

Patent Document 1: Japanese Patent-Laid Open No. 2011-232535

SUMMARY OF THE INVENTION

Problems to be Solved by the Invention

In general, when the luminance of the light source is adjusted by a lighting duty ratio, there is a trade-off between the scan effect and the luminous efficiency (power saving performance). That is, the smaller the lighting duty ratio is to improve the scan effect, the greater the drive current is needed and thus the luminous efficiency of the light source is deteriorated. On the other hand, the smaller the drive current is to improve the luminous efficiency of the light source, the greater the light duty ratio is needed and thus the scan effect is impaired.

The backlight scanning described in Patent Document 1 adjusts the trade-off of the scan effect and the luminous efficiency of the backlights by switching combinations of the lighting duty ratio and the drive current according to the speed of the motion on the screen. Therefore, it is essential to include a component to detect the speed of the motion on the screen.

The present invention provides a display device having a simpler constitution with which a favorable trade-off between the scan effect and the luminous efficiency can be obtained regardless of the speed of the motion on the screen.

Means for Solving the Problems

A display device according to an embodiment of the present invention includes a display, a light source and a controller which controls output of a drive signal to the light source based on duty ratio characteristics and amplitude characteristics corresponding to a luminance of the light source. With a predetermined luminance of the light source as a boundary, the amplitude characteristics are divided into a first region which is less than or equal to the predetermined luminance, and a second region which is higher than the predetermined luminance. A change rate of an amplitude of the drive signal with respect to the luminance of the light source is less than or equal to a predetermined change rate in the first region, and the amplitude characteristics in the second region differ from the amplitude characteristics in the first region.

Here, the first region of the amplitude characteristics may be indicated as a straight line or a curved line.

Also, the change rate of the amplitude of the drive signal with respect to the light source may be greater than the predetermined change rate in the second region of the amplitude characteristics.

Here, the second region of the amplitude characteristics may be indicated as a straight line or a curved line.

Also, the range of the luminance of the first region may be greater than or equal to the range of the luminance of the second region.

Also, the duty ratio characteristics may indicate a greater duty ratio as the luminance of the light source is higher.

Furthermore, the duty ratio characteristics are divided with the predetermined luminance as a boundary, into a third region which is less than or equal to the predetermined luminance, and a fourth region which is higher than the predetermined luminance. The change rate of the duty ratio of the drive signal with respect to the luminance of the light source in the third region may be smaller than the change rate of the duty ratio of the drive signal with respect to the luminance of the light source in the fourth region.

According to such a constitution, the amplitude of the drive signal may be boosted by a change rate less than or equal to the predetermined change rate in the first region of the amplitude characteristics. Boosting by the change rate less than the predetermined change rate in the first region includes a case where the change rate of the amplitude of the drive signal in the first region is zero, that is, a case where the amplitude of the drive signal is fixed to constant amplitude.

Thereby, compared to a case where the drive signal is not boosted at all, that s, a case where a desired luminance is achieved by changing the duty ratio using a drive signal with constant amplitude for the entire region of the luminance of the light source, a higher luminance can be achieved with the same duty ratio. As a result, the upper limit of the luminance with which the scan effect is obtained is increased, and the scan effect can be obtained in a wider range of luminance.

Since the change rate of the amplitude of the drive signal in the first region is less than or equal to the predetermined change rate, the expansion width of the amplitude of the drive signal is reduced, and as a result, deterioration of the luminous efficiency of the light source is suppressed.

Also, when the amplitude of the drive signal is fixed to constant amplitude in the first region, the amplitude of the drive signal is expanded only in the second region along with a decrease in the luminance. Therefore, deterioration of the luminous efficiency of the light source associated with the boosting of the drive signal does not occur in the first region.

In this way, according to the above-mentioned display device, a favorable trade-off between the scan effect and the luminous efficiency can be obtained regardless of the speed of the motion on the screen.

Also, the duty ratio of the drive signal at the predetermined luminance may be configured based on a response speed of the display.

Furthermore, the duty ratio of the drive signal at the predetermined luminance may be substantially equal to a ratio of a period in which the transmittance of the display is at a predetermined transmittance over a vertical scan period.

In this way, the predetermined luminance matches the upper limit of the range of the luminance within which the scan effect can be obtained, and the scan effect is achieved in the entire region of the first region. Therefore, it is not necessary to increase the amplitude of the drive signal in the first region, and unnecessary deterioration of the luminous efficiency of the light source can be avoided.

Effect of the Invention

According to the display device of the present invention, a favorable trade-off between the scan effect and the luminous efficiency can be obtained regardless of the speed of the motion on the screen.

DETAILED DESCRIPTION OF THE EMBODIMENTS

Before describing embodiments of the present invention, motion blur occurring when a motion video is played in a liquid crystal display device is explained using comparative examples. An example of double-imaging is used to explain motion blur so that the relationship between the lighting duty ratio of the backlights and motion blur may be easily understood.

Comparative Example 1

Firstly, the principle of motion blur occurring in the liquid crystal display device is explained.

Figure 15:
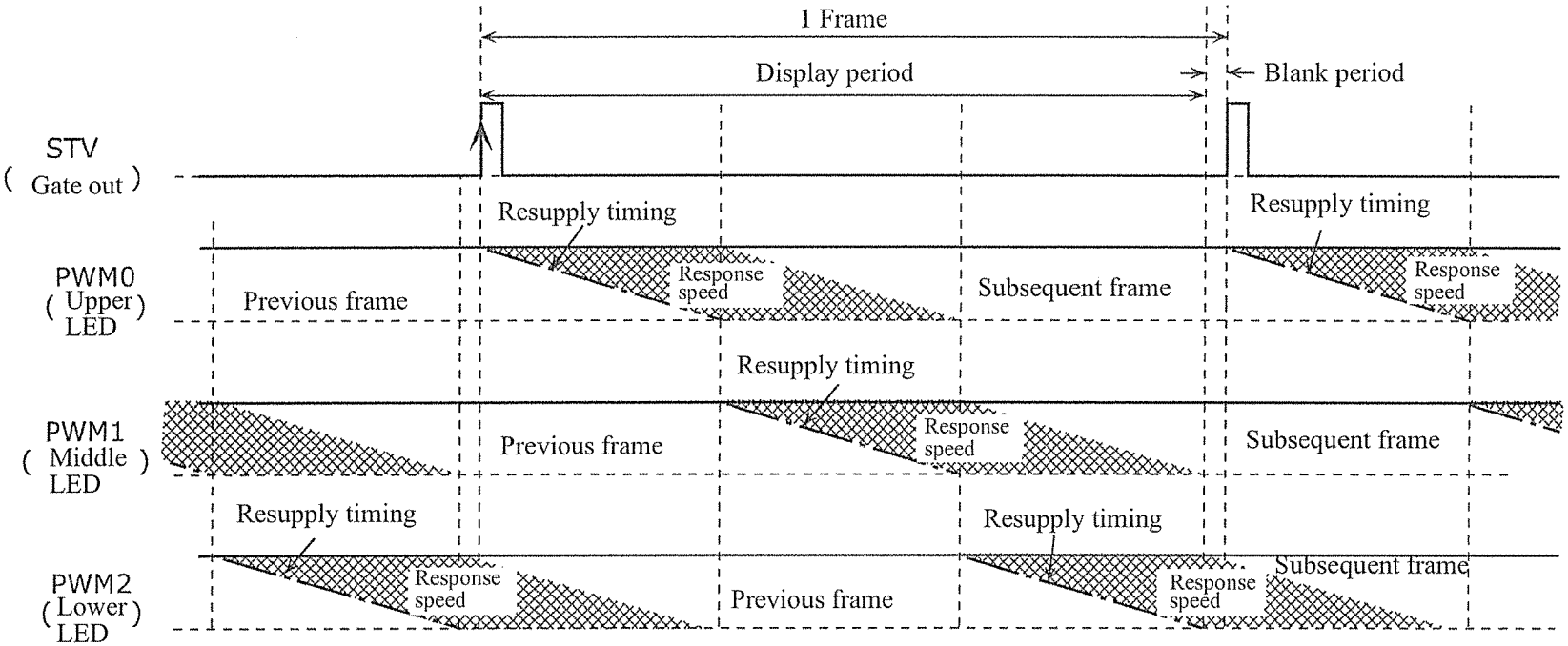
FIG. 15 is a timing chart schematically illustrating an example of the lighting and extinguishing timing of the backlight panel and the supply timing of the signal voltage to the liquid crystal panel in the liquid crystal display device of the comparative example 1.

FIG. 15 is a timing chart schematically illustrating an example of the lighting and extinguishing timing of the backlight panel and the supply timing of the signal voltage to the liquid crystal panel of the liquid crystal display device of the comparative example 1.

The liquid crystal display device includes a liquid crystal panel in which a plurality of liquid crystal pixels are arranged in matrix, a plurality of backlights each of which respectively illuminates each different partial region of the liquid crystal panel (for example, a region comprised of a plurality of lows) and a backlight drive circuit which supplies drive current to the plurality of backlights.

Supplying of scanning signals to liquid crystal pixel groups is performed by gate drivers, each of which respectively drives the upper portion, the middle portion and the lower portion of the liquid crystal panel. Each of the gate drivers supplies a signal voltage corresponding to a scanning signal, which is a digital datum, to the liquid crystal panel. Here, supplying the signal voltage to the liquid crystal panel means applying the signal voltage to the liquid crystal pixel groups constituting the liquid crystal panel.

The plurality of backlights is constituted by LEDs (Light Emitting Diodes), for example, and includes an LED disposed so as to correspond to the upper portion of the liquid crystal panel (Upper LED), an LED disposed so as to correspond to the middle portion of the liquid crystal panel (Middle LED) and an LED disposed so as to correspond to the lower portion of the liquid crystal panel (Lower LED).

The backlight drive circuit includes the plurality of backlight drivers and supplies the drive current to the backlights to light the backlights during the lighting period of the backlights. Specifically, the backlight drive circuit supplies the drive current to the LED disposed to correspond to the upper portion of the liquid crystal panel during a period in which a pulse signal PWM0 is active, supplies the drive current to the LED disposed to correspond to the middle part of the liquid crystal panel during a period in which a pulse signal PWM1 is active, and supplies the drive current to the LED disposed to correspond to the lower part of the liquid crystal panel during a period in which a pulse signal PWM2 is active.

In the comparative example 1, the lighting duty ratio is 100%. That is, the pulse signals PWM0 to PWM2 are active all the time and the backlights are lit all the time.

The operation of the liquid crystal display device of the comparative example 1 is described below.

The liquid crystal display device supplies the signal voltage to the liquid crystal panel by sequentially driving each of the gate drivers when a signal STV rises. The STV is a signal indicating the supply timing of the scanning signal to the first row of the liquid crystal pixel groups.

The line of the liquid crystal pixels to which the signal voltage is supplied transmits the light by the transmission amount corresponding to the signal voltage of the next frame, taking a time period according to the response speed of the liquid crystal pixels. That is, an image which matches the scanning signal of the next frame is displayed.

However, in such a liquid crystal display device, when the signal voltage is resupplied from the previous frame to the next frame, there exist problems such as displayed images are overlapped or blurring due to the response speed of the liquid crystal occurs. Specifically, since the backlights are lit all the time because of the lighting duty ratio being 100%, the liquid crystal pixels transmit the light from the backlights even during the response period of the liquid crystal pixels after resupplying of the signal voltage. That means both the image of the frame before the resupplying and the image of the frame after the resupplying are displayed when resupplying the signal voltage. In other words, a double image is displayed.

Comparative Example 2

To suppress double-imaging in such a liquid crystal display device (that is, to obtain the scan effect), a constitution that decreases the lighting duty ratio and extinguishes the corresponding backlights when resupplying the signal voltage can be considered.

Figure 16:
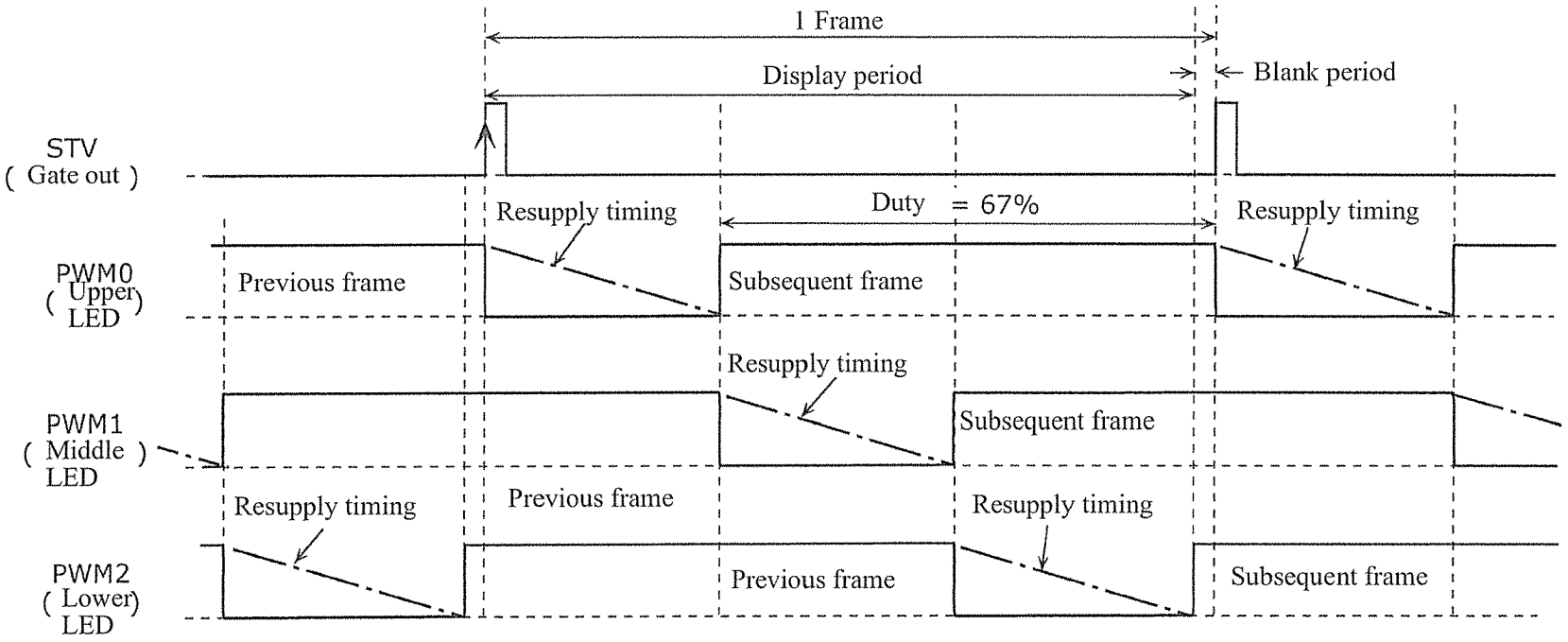
FIG. 16 is a timing chart schematically illustrating an example of the lighting and extinguishing timing of the backlight panel and the supply timing of the signal voltage to the liquid crystal panel in the liquid crystal display device of the comparative example 2.

FIG. 16 is a timing chart schematically illustrating an example of the lighting and extinguishing timing of a backlight panel and the supply timing of the signal voltage to the liquid crystal panel of the liquid crystal display device of the comparative example 2. This comparative example describes the response period of the liquid crystal pixels to be zero for the explanation purpose.

As shown in FIG. 16, the liquid crystal display device of the comparative example 2 extinguishes the backlights at the supply timing of the next scanning signal. Specifically, the lighting duty ratio of the pulse signals PWM0 to PWM2 are set to 2/3 (≈67%), and the corresponding backlights are extinguished by setting the pulse signals PWM0 to PWM2 to inactive (level L) when resupplying the signal voltage of the liquid crystal pixels.

Thereby, double-imaging at the resupply time of the signal voltage is suppressed and the scan effect can be obtained. Moreover, by extinguishing the corresponding backlights during the response period of the liquid crystal pixels, motion blur during the response period of the liquid crystal pixels is also suppressed, and the sufficient scan effect is obtained.

Figure 17:
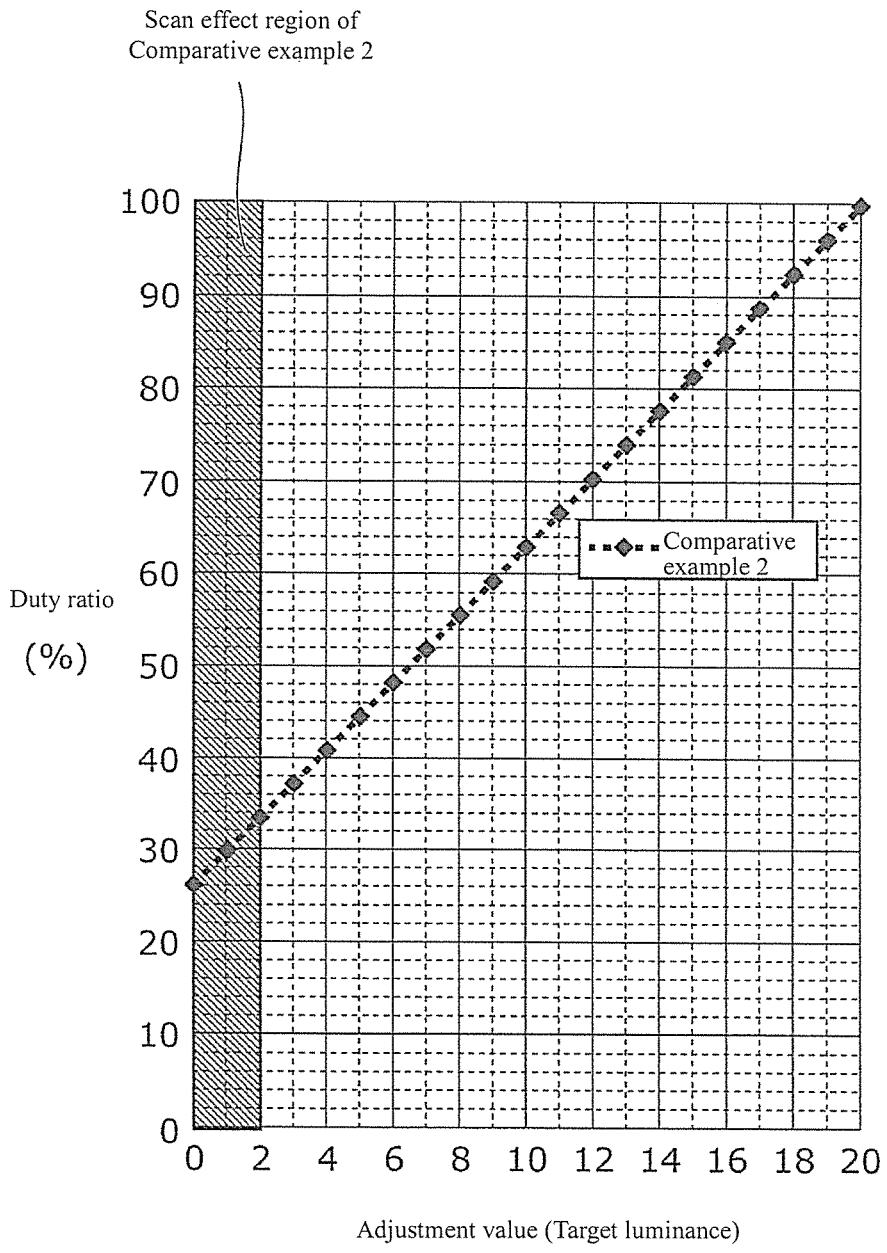
FIG. 17 is a graph illustrating the lighting duty ratio with respect to the adjustment value of the liquid crystal display device of the comparative example 2.

FIG. 17 is a graph illustrating the lighting duty ratio with respect to the adjustment value of the liquid crystal display device of the comparative example 2. Here, the adjustment value means the value specified from a predetermined range of the luminance as a target luminance of the backlights, and the higher the adjustment value is, the higher the luminance is specified. This description uses the adjustment value and the target luminance as the same meaning.

In FIG. 17, the amplitude of the drive current is constant, and it is assumed that the target luminance is achieved by changing the lighting duty ratio. In this way, as shown in FIG. 17, the higher the adjustment value is, the higher the lighting duty ratio becomes to make the backlights emit light at a higher luminance. The lower the adjustment value is, the lower the lighting duty ratio becomes to make the backlights emit light at a lower luminance.

For example, when the backlights of the liquid crystal display device of the comparative example 2 are built into a three-row constitution and a single vertical scan period is Vs, the response period of the display is (1/3)Vs. In this case, both double-imaging and motion blur can be suppressed by setting the lighting duty ratio to be 1/3 (≈33%) and extinguishing the backlights at the time of resupplying the signal voltage of the liquid crystal pixels and during the response period of the liquid crystal pixels.

More generally speaking, a sufficient scan effect can be obtained if a target luminance is achieved by a combination of the amplitude of a substantially large drive current and the lighting duty ratio which is less than or equal to the ratio of a period in which the transmittance of the partial region illuminated by the backlights of the display is stable (that is, a period in which the transmittance of the display becomes the transmittance indicated by the supplied signal voltage, and, for example, excluding the supply period of the signal voltage and the response period of the display) over a single vertical scan period (for example, above-mentioned 33%). A sufficient scan effect cannot be obtained if the target luminance is achieved by a combination of the amplitude of a substantially small drive current and the lighting duty ratio which exceeds the above-mentioned ratio.

In the example shown in FIG. 17, the target luminance which can be achieved by the drive current with constant amplitude, which is a premise of this example, and the lighting duty ratio less than or equal to 33% is only the target luminance within a range of 0 to 2. To achieve the target luminance higher than 2, a lighting duty ratio greater than 33% is required, and the scan effect to be obtained is reduced.

To obtain a sufficient scan effect (for example, a lighting duty ratio less than or equal to 33%) for the target luminance higher than the example shown in FIG. 17 (for example, higher than 2), it is effective to boost the drive current, that is, to make the lighting duty ratio smaller by making the amplitude of the drive current greater.

Also, there is a problem that motion blur may be occurred by an afterimage remains on a retina even the response period of liquid crystal pixels is shortened because liquid crystal pixels are operated by hold-type driving, but making the lighting duty ratio smaller by boosting the drive current is also effective to remedy this type of motion blur.

However, simply boosting the drive current may cause the following issues. When the lighting duty ratio is increased while boosting the current, there is a risk that the power loss occurred in the backlights exceeds the maximum allowable loss. Also, there is a problem that the greater the amplitude of the drive current is made by increasing the intensity of boosting, the lower the luminous efficiency (power saving performance) of the backlight becomes.

The backlight drive circuit of each embodiment of the present invention is proposed to solve such problems.

The embodiments are hereinafter described in detail based on the drawings. Each of the embodiments described below is for showing a concrete example of the present invention. The figures, shapes, materials, components, arrangement positions of the components, connection topologies, etc. shown in the embodiments below are examples, and the present invention is not limited thereto. Among the components of the embodiments below, those not described in independent claims are described as optional components.

First Embodiment

The backlight drive circuit of the first embodiment is a backlight drive circuit that makes a plurality of backlights for illuminating the liquid crystal panel emit light at a target luminance selected from a predetermined range, and is mounted on a liquid crystal display device used in, for example, a television receiver, etc.

<1-1. Constitution>

The constitution of the backlight drive circuit of the first embodiment is described below.

[Liquid Crystal Display Device]

Figure 1:
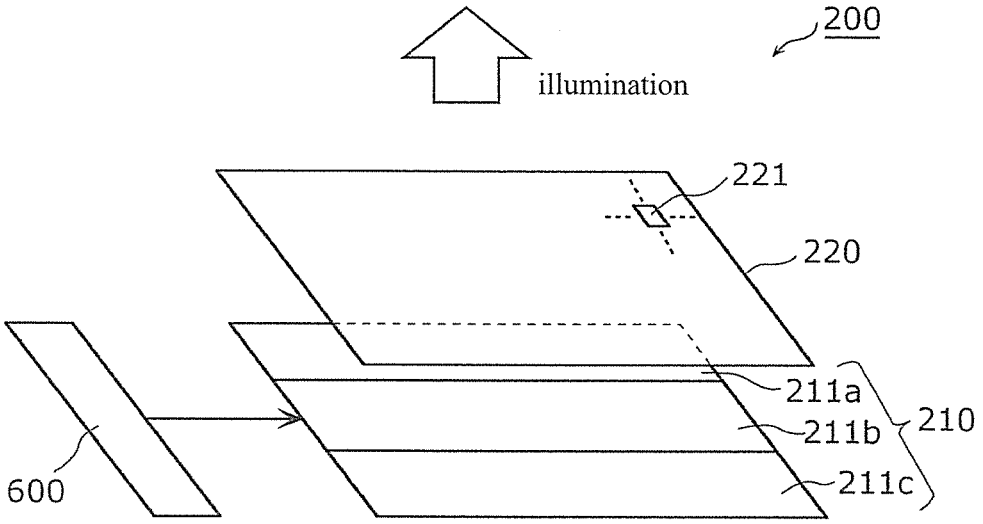
FIG. 1 is a block diagram illustrating a constitution of a liquid crystal display device mounting a backlight drive circuit of the first embodiment.

FIG. 1 is a block diagram illustrating a constitution of a liquid crystal display device 200 mounting a backlight drive circuit 600 of the first embodiment.

The liquid crystal display device 200 shown in FIG. 1 includes the backlight drive circuit 600 of the first embodiment, a backlight panel 210 and a liquid crystal panel 220 in which a plurality of liquid crystal pixels 221 are arranged in matrix. Here, the liquid crystal display device 200 is an example of the display device, and the backlight drive circuit 600 is an example of a light source drive part, and the liquid crystal panel 220 is an example of the display. The light source drive part includes the controller.

The backlight panel 210 is disposed immediately below the liquid crystal panel 220, and has a plurality of backlights 211*a* to 211*c*. In this embodiment, the backlight panel 210 has three backlights, but the number of backlights is not limited thereto. The backlight panel 210 may have 10 or 20 backlights.

Each of the plurality of backlights 211*a* to 211*c* is disposed so as to correspond to each different partial region of the liquid crystal panel 220, and emits light by the drive current supplied by the backlight drive circuit 600 and illuminates each of the corresponding partial regions. Specifically, the plurality of partial regions maybe regions obtained by dividing the liquid crystal panel 220 into three, the upper portion, the middle portion and the lower portion, and each partial region may include a plurality of rows of the matrix to which the liquid crystal pixels 221 are arranged. Here, each of the backlights 211*a* to 211*c* is an example of the light source, and the drive current is an example of the drive signal.

The backlights 211*a* illuminates the upper portion of the liquid crystal panel 220; the backlights 211*b* illuminates the middle portion of the liquid crystal panel 220; and the backlights 211*c* illuminates the lower portion of the liquid crystal panel 220. The backlights 211*a* to 211*c* include, for example, current-driven light emitting elements such as LEDs, etc. Thus, each of the partial regions of the backlight panel 210 emits light at a luminance corresponding to the amount of current flowing into the backlights 211*a* to 211*c*.

In FIG. 1, the backlights 211*a* to 211*c* are illustrated as a long shape, but the shape of the backlights is not limited thereto and may have a substantially square shape. Also, in this embodiment, each of the backlights 211*a* to 211*c* is arranged in line in a row direction, but the arrangement of the backlights is not limited thereto. The backlights may be arranged in line in a column direction or in matrix. Hereinafter, the backlights 211*a* to 211*c* may be referred to as backlights 211 without making any particular distinction among them.

The liquid crystal panel 220 is a display panel in which the plurality of liquid crystal pixels 221 is arranged in matrix (for example, 1920 lines, 1080 columns), and displays a motion video represented by the video signal which is input from the outside of the liquid crystal display device 200.

Each of the liquid crystal pixels 221 the liquid crystal panel 220 has includes a liquid crystal layer, liquid crystal pixels having pixel electrodes to which the signal voltage is applied and counter electrodes opposing the pixel electrodes, and a TFT (Thin Film Transistor) that applies the signal voltage to the pixel electrodes of the liquid crystal elements. The liquid crystal elements change the polarization direction of light according to the signal voltage applied to the pixel electrodes of the liquid crystal element through the TFT. The TFT applies the signal voltage which is output to source lines disposed in each column of the liquid crystal pixels from a source driver (not depicted) to the pixel electrodes of the liquid crystal pixels 221 of the corresponding row at the timing indicated by high and low of the gate pulse which is output to gate lines disposed in each line of the liquid crystal pixels from a gate driver (not depicted). In short, the TFT supplies the signal voltage to the liquid crystal pixels 221. As a result, the liquid crystal panel 220 transmits the light from the backlights 211 corresponding to the liquid crystal pixels 221 at the transmission amount according to the signal voltage indicating the luminance of the liquid crystal pixels 221 supplied to each of the liquid crystal pixels 221.

The backlight drive circuit 600 supplies the drive current for making the backlight panel 210 emit light at a target luminance to the backlights 221*a*, 221*b* and 221*c*.

[Detailed Constitution of Backlight Drive Circuit]

Next, the detailed constitution of the backlight drive circuit 600 is described.

Figure 2:
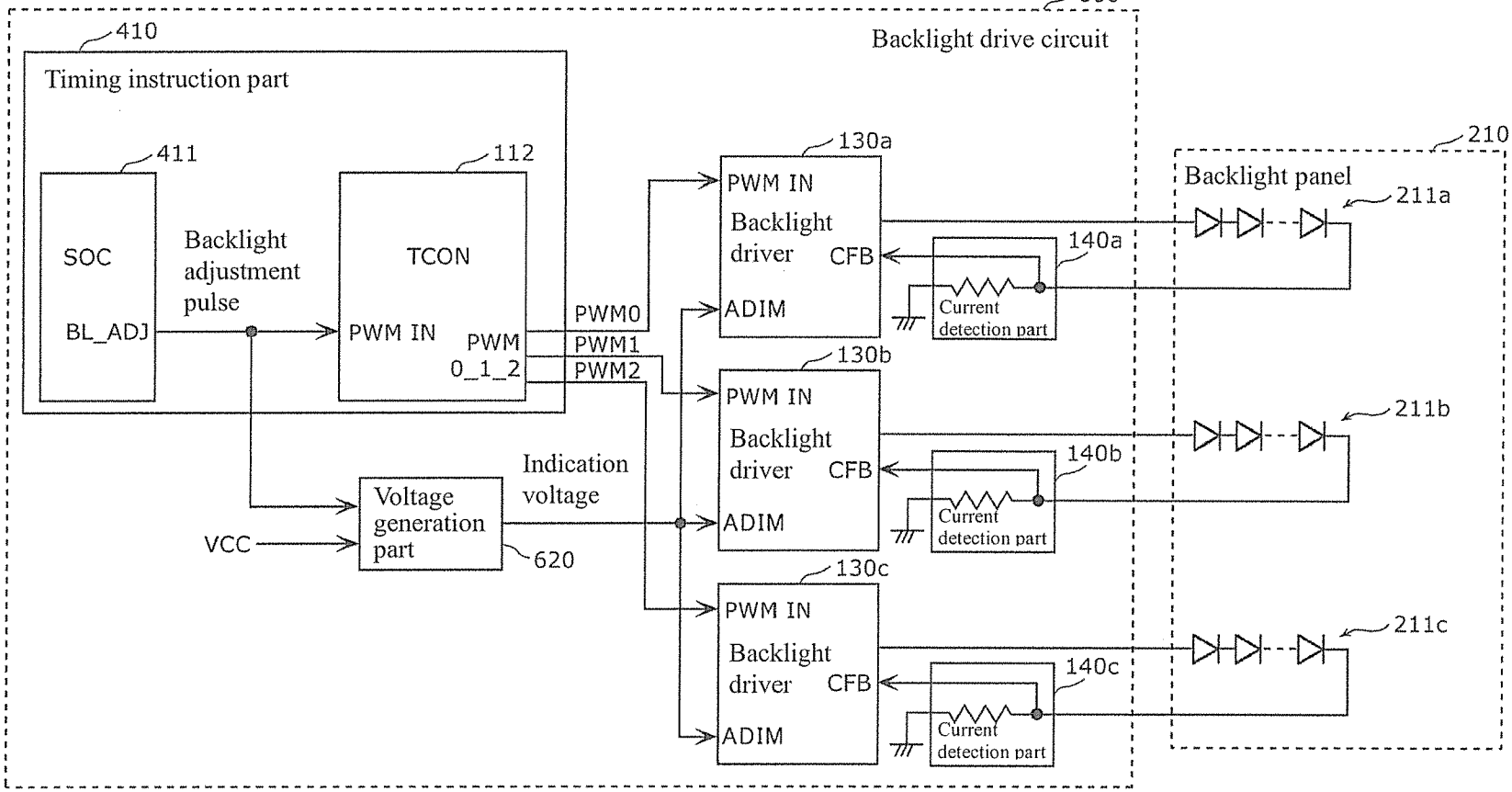
FIG. 2 is a block diagram illustrating the detailed constitution of the backlight drive circuit.

FIG. 2 is a block diagram illustrating the detailed constitution of the backlight drive circuit 600.

The backlight drive circuit 600 shown in FIG. 2 includes a timing instruction part 410, a voltage generation part 620, backlight drivers 130*a* to 130*c* and current detection parts 140*a* to 140*c*. In FIG. 2, the backlight panel 210 to which the drive current is supplied by the backlight drivers 130*a* to 130*c* is also depicted.

The timing instruction part 410 is the part which instructs the lighting and extinguishing timing of each of the backlights 211 so that the higher the target luminance is, the longer the lighting period of the backlight 211 becomes (that is, to make the duty ratio of the pulse width modulation greater). The timing instruction part 410 has a SOC (System-on-a-Chip) 411 which generates backlight adjustment pulses indicating the target luminance and a TCON (Timing Controller) 112 which generates pulse signals PWM0 to PWM2 indicating the lighting and extinguishing timing of each of the backlights 211.

As mentioned earlier, the target luminance is a luminance specified from a predetermined range (for example, a range of 0 to 20). The target luminance may be specified by user operation or according to the brightness of the surroundings measured by a luminance sensor attached to the liquid crystal display device.

The SOC 411 generates the backlight adjustment pulse which indicates the target luminance of the backlight panel 210 as a duty ratio of the pulse width modulation. The SOC 411 supplies the generated backlight adjustment pulse to the TCON 112 and the voltage generation part 620. The backlight adjustment pulse may be, for example, a pulse width modulation signal which indicates a greater target luminance as a greater duty ratio.

The TCON 112 synchronizes the pulse signals PWM0 to PWM2, which indicate the backlight adjustment pulses supplied by the SOC 411 and duty ratios of which become greater as the target luminance is greater, with a vertical synchronization signal supplied to the liquid crystal panel 220 and then outputs. Specifically, by converting the backlight adjustment pulses so as to synchronize with the vertical synchronization signal and sequentially delaying the active period, the pulse signals PWM0 to PWM2 indicating the lighting and extinguishing timing of each of the backlights 211 are generated. The TCON may hold, for example, reference information which indicates the association of the target luminance and the duty ratio as a format of a table or a function formula, etc., and may generate the pulse signals PWM0 to PWM2 of the duty ratio corresponding to the target luminance indicated by the backlight adjustment pulse by using the reference information.

Here, the pulse signals PWM0 to PWM2 are signals that respectively control the lighting and extinguishing timing of the backlights 211*a* to 211*c*. A period in which the pulse signals PWM0 to PWM2 are active corresponds to the lighting period of the backlights 211*a* to 211*c*, and a period in which the pulse signals PWM0 to PWM2 are inactive corresponds to the extinguished period of the backlights 211*a* to 211*c*.

Before the signal voltage is supplied to the liquid crystal pixels 221 disposed to the partial regions of the liquid crystal panel 220 which is illuminated by the backlights 221*a* to 221*c*, the TCON 112 inactivates the corresponding pulse signals PWM0 to PWM2. The TCON 112 may, for example, detect the time period at which the signal voltage is supplied to the liquid crystal pixels 221 disposed to the partial regions illuminated by each of the backlights 221*a* to 221*c*, and inactivate the corresponding pulse signals PWM0 to PWM2 by the detected time period.

The voltage generation part 620 generates an indication voltage which indicates the amount of current according to the target luminance indicated by the backlight adjustment pulse supplied from the SOC 411. Specifically, when the target luminance is less than or equal to the predetermined luminance, the voltage generation part 620 generates an indication voltage indicating the first amount of current which is fixed regardless of the target luminance. When the target luminance is higher than the predetermined luminance, the voltage generation part 620 generates an indication voltage indicating the second amount of current which becomes smaller as the target luminance is higher, with the first amount of current set as the maximum amount thereof.

The indication voltage may be, for example, a voltage signal indicating higher current as higher voltage. Such an indication voltage can be generated by, for example, clipping the voltage which inversely indicates the level of the target luminance indicated by the backlight adjustment pulse with the voltage corresponding to the first amount of current. The detailed constitution of the voltage generation part 620 generating such an indication voltage is described.

Figure 3:
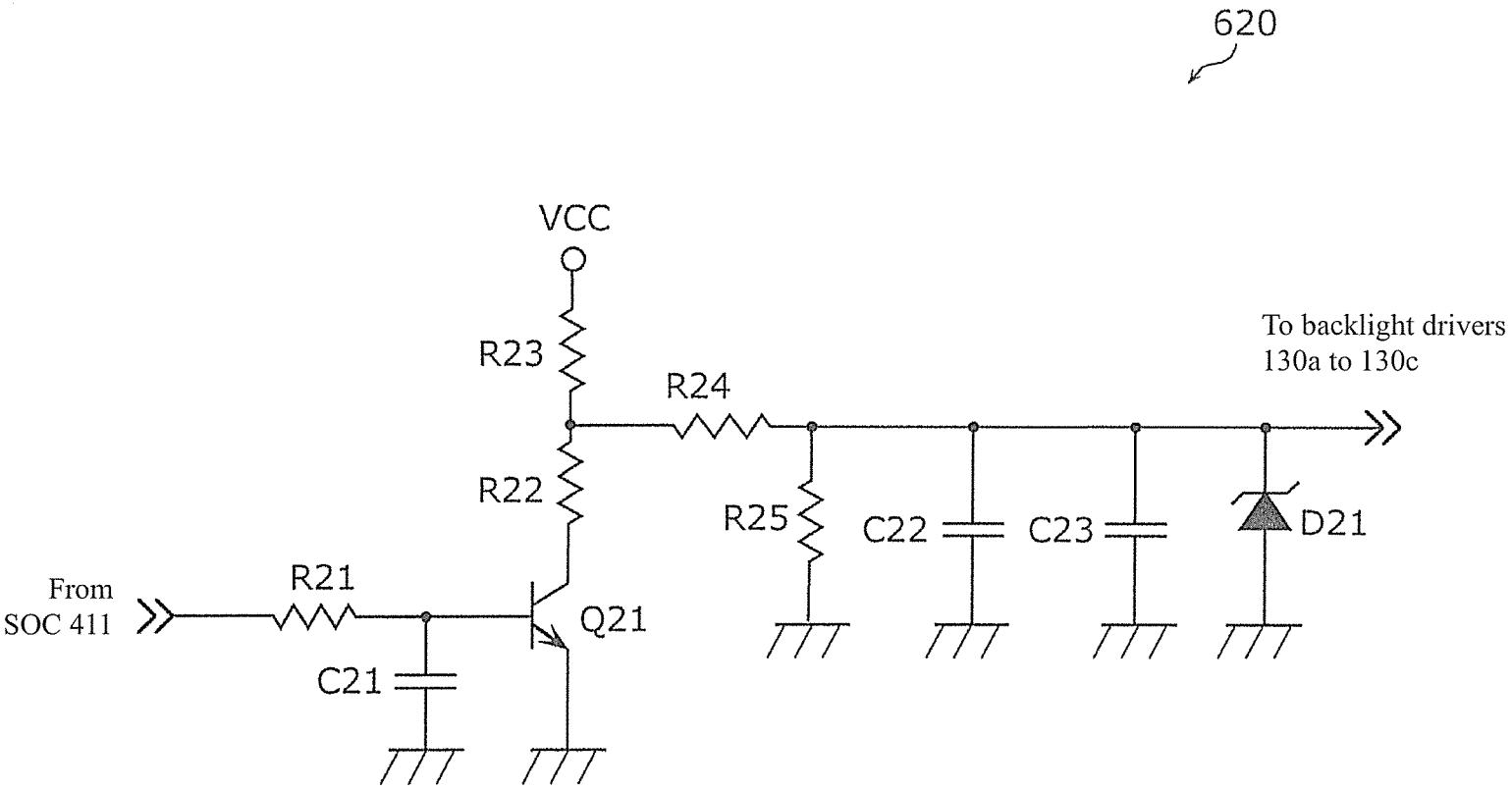
FIG. 3 is a circuit diagram illustrating an example of the detailed constitution of the voltage generating part.

FIG. 3 is a circuit diagram illustrating an example of the detailed constitution of the voltage generation part 620.

The voltage generation part 620 includes resistors R21 to R25, capacitors C21 to C23, a transistor Q21 and a zener diode D21.

The resistors R21, R22 and R23, the capacitor C21 and the transistor Q21 constitute an inverter circuit which inverts the voltage level of the backlight adjustment pulse. The capacitor C21 removes high frequency noise the backlight adjustment pulse contains.

The resistors R24 and R25 and the capacitors C22 and C23 constitute an integrator circuit which converts a duty ratio of the backlight adjustment pulse, the voltage level of which is inverted, to a voltage. The voltage obtained at the integrator circuit corresponds to the value yielded by subtracting the duty ratio of the original backlight adjustment pulse from 1 (that is, 100%). The zener diode D21 generates the indication voltage by clipping the obtained voltage with the voltage corresponding to the first amount of current.

The indication voltage generated in the voltage generation part 620 in this way indicates the first amount of current, which is fixed regardless of the target luminance, when the target luminance is less than or equal to the predetermined luminance, and indicates the second amount of current, which becomes smaller as the target luminance is higher with the first amount of current set as the maximum amount thereof, when the target luminance is higher than the predetermined luminance. The generated indication voltage is supplied to the backlight drivers 130*a* to 130*c*.

The description continues with referring to FIG. 2 again.

The backlight drivers 130*a* to 130*c* are drivers disposed so as to correspond to the backlights 211*a* to 211*c* and supply the drive current to the corresponding backlights 211*a* to 211*c*. Hereinafter, the backlight drivers 130*a* to 130*c* may be referred to as backlight drivers 130 without making any particular distinction among them.

The current detection parts 140*a* to 140*c* are sensors disposed so as to correspond to the backlights 211*a* to 211*c*, and detect the amount of current of the drive current flowing into the backlights 211*a* to 211*c* and output a feedback signal which indicates the detected amount of current. Hereinafter, the current detection parts 140*a* to 140*c* may be referred to as current detection parts 140 without making any particular distinction among them.

During the period in which the pulse signal provided from the TCON 112 is active, the backlight drivers 130 supply the drive current to the backlights 211, and the amount of the drive current is the amount with which the amount of current indicated by the feedback signal provided by the current detection parts 140 and the amount of current indicated by the indication voltage provided by the voltage generation part 620 become the same. During the period in which the pulse signal is inactive, the backlight drivers 130 stop supplying the drive current. The active or inactive of the pulse signal may be indicated by, for example, the level H or the level L of the pulse signal.

Specifically, the backlight drivers 130*a* to 130*c* generate pulse width modulated current by applying chopper control to the current the amount of which is indicated by the indication voltage according to the pulse signals PWM0 to PWM2 respectively, and then supply the generated current respectively to the backlights 211*a* to 211*c* as the drive current.

The backlight drivers 130*a* to 130*c* may be constituted with, for example, a driver IC (Integrated Circuit) having a variable current regulator function and a current chopper function. The current detection parts 140*a* to 140*c* may be constituted with, for example, shunt resistors.

By the drive current which is pulse width modulated according to the pulse signals PWM0 to PWM2, the three backlights 211*a* to 211*c* are sequentially lit and extinguished at a duty ratio that is greater as the target luminance is higher.

In this way, each of the backlights 211*a* to 211*c* are extinguished before the signal voltage is supplied to the liquid crystal pixel groups in the lines corresponding to the backlight 211*a* to 211*c*. Accordingly, double-imaging caused by the backlights 211 being lit at the time of supplying of the signal voltage can be suppressed.

Also, the amplitude of the drive current is the first amplitude, which is fixed regardless of the target luminance, when the target luminance is less than or equal to the predetermined luminance. When the target luminance is higher than the predetermined luminance, the amplitude of the drive current is the second amplitude, which is smaller as the target luminance is higher with the first amplitude set as the maximum value thereof.

Thus, the amplitude of the drive current is boosted by the first amplitude when the target luminance is less than or equal to the predetermined luminance. As the target luminance becomes higher beyond the predetermined luminance, the amplitude of the drive current continuously becomes small from the first amplitude to the normal amplitude, which is defined as the amplitude when the target luminance is at maximum.

In this way, a higher target luminance can be achieved with the same duty ratio compared to the case where the current boosting is not performed, that is, the case where the target luminance is achieved by changing the duty ratio with the drive current of a constant amplitude. Therefore, the upper limit of the target luminance with which the scan effect can be obtained is increased.

In addition, because the drive current is boosted with the first amplitude as the upper limit, the deterioration of the luminous efficiency associated with the increase of the amplitude of the drive current is suppressed to the luminous efficiency obtained with the drive current with the first amplitude.

In this way, according to the backlight drive circuit 600, a favorable trade-off between the scan effect and the luminous efficiency can be obtained regardless of the speed of the motion on the screen.

Also, since the amplitude of the drive current continuously changes along with the change of the target luminance from the first amplitude to the normal amplitude, flicker occurred because of the discontinuity of the amplitude of the drive current at the time of switching of the target luminance can be suppressed.

Also, because the amplitude of the drive current is decreased from the first amplitude according to the target luminance exceeding the predetermined luminance, a disadvantage that the power loss in the backlights 211 exceeds the maximum allowable loss, concerned when increasing the duty ratio with maintaining the first amplitude of the drive current, is avoided.

<1-2. Operation>

Next, the operation of the liquid crystal display device 200 of this embodiment is described with referring to drawings.

Figure 4:
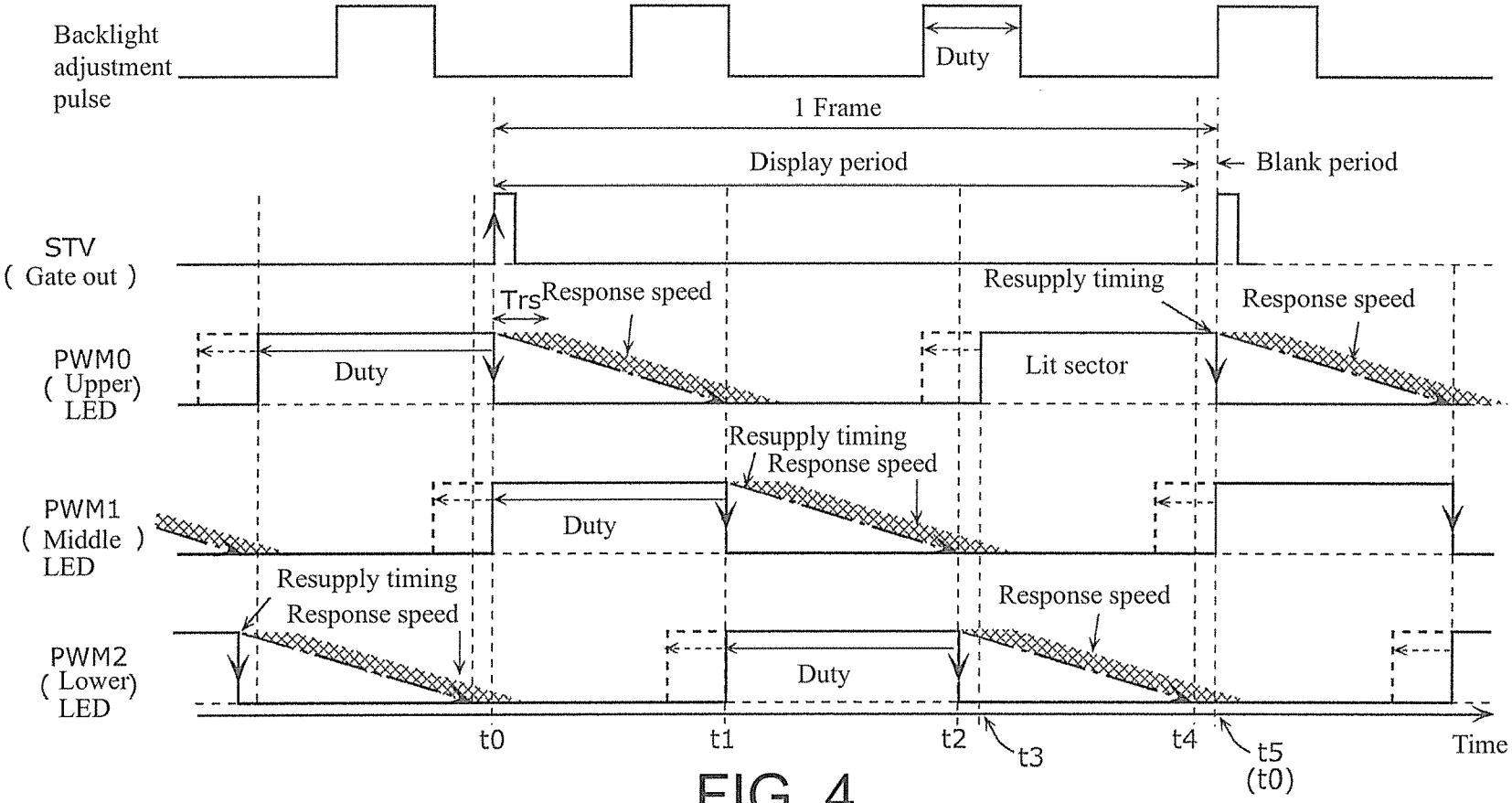
FIG. 4 is a timing chart schematically illustrating an example of the lighting and extinguishing timing of the backlight panel and the supply timing of the signal voltage to the liquid crystal panel in the first embodiment.

FIG. 4 is a timing chart schematically illustrating an example of the lighting and extinguishing timing of the backlight panel and the supply timing of the signal voltage to the liquid crystal panel.

FIG. 4 schematically illustrates, in order from the top, the backlight adjustment pulse, the vertical synchronization signal STV, the pulse signal PWM0 corresponding to the backlight 211*a* and the resupply timing of the signal voltage to the liquid crystal pixels 221 in pixel lines corresponding to the backlight 211*a*, the pulse signal PWM1 corresponding to the backlight 211*b* and the resupply timing of the signal voltage to the liquid crystal pixels 221 in pixel lines corresponding to the backlight 211*b*, the pulse signal PWM2 corresponding to the backlight 211*c* and the resupply timing of the signal voltage to the liquid crystal pixels 221 in pixel lines corresponding to the backlight 211*c*.

As shown in FIG. 4, the backlight adjustment pulse generated at the SOC 411 and each of the pulse signals PWM0 to PWM2 are of the same duty ratio. Specifically, the pulse signals PWM0 to PWM2 are the pulse signals which have the same duty ratio as the backlight adjustment pulse and are delayed for a predetermined period within a single display period.

Firstly, at the time t0, when the vertical sync signal STV rises, supplying of the signal voltage starts line by line to each of the liquid crystal pixels 221 in the upper portion of the liquid crystal panel 220 which corresponds to the backlight 211*a*. By the time t0, the pulse signal PWM0 has become inactive (level L). That is, by the time the supplying to each of the liquid crystal pixels 221 in the upper portion of the liquid crystal panel 220 starts, the backlight drive circuit 600 extinguishes the backlight 211*a* corresponding to the upper portion of the liquid crystal panel 220.

Then, until the time t1, the signal voltage is supplied to each of the liquid crystal pixels 221 of the upper portion of the liquid crystal panel 220. Here, the time required from the supplying of the signal voltage to the liquid crystal pixels 221 until the liquid crystal pixels transmit the amount of light corresponding to the supplied signal voltage is defined as a response speed Trs of the display. The response speed of the display is determined by the constitution, material, etc. of each of the liquid crystal pixels 221. Therefore, each of the liquid crystal pixels 221 transmits the amount of light corresponding to the supplied signal voltage after the Trs has passed since the signal voltage is supplied.

Also, at the time t0, the pulse signal PWM1 rises as active (level H). That is, the backlight drive circuit 600 switches the backlight 211*b* corresponding to the middle portion of the liquid crystal panel 220 from off to on. Thereby, on the middle part of the liquid crystal panel 220, an image corresponding to the signal voltage supplied in the previous frame is displayed.

Then, until right before the time t1, the backlight drive circuit 600 keeps lighting the backlight 211*b*. Thus, from the t0 to right before the t1, an image corresponding to the signal voltage supplied in the previous frame is displayed on the middle portion of the liquid crystal panel 220.

Next, at the time t1, supplying of the signal voltage starts line by line to each of the liquid crystal pixels 221 in the middle portion of the liquid crystal panel 220 which corresponds to the backlight 211*b*. The pulse signal PWM1 becomes inactive (level L) right before the time t1. That is, before the supplying to each of the liquid crystal pixels 221 of the middle portion of the liquid crystal panel 220 starts, the backlight drive circuit 600 extinguishes the backlight 221*b* corresponding to the middle portion of the liquid crystal panel 220. Then, until the time t2, the signal voltage is supplied to each of the liquid crystal pixels 221 of the middle portion of the liquid crystal panel 220.

Also, at the time t1, the pulse signal PWM2 rises as active (level H). That is, the backlight drive circuit 600 switches the backlight 221*c* corresponding to the lower portion of the liquid crystal panel 220 from off to on. Thereby, on the lower portion of the liquid crystal panel 220, an image corresponding to the signal voltage supplied in the previous frame is displayed.

Then, until right before the time t2, the backlight drive circuit 600 keeps lighting the backlight 221*c*. Thus, from the t1 to right before the t2, an image corresponding to the signal voltage supplied in the previous frame is displayed on the lower portion of the liquid crystal panel 220.

Next, at the time t2, supplying of the signal voltage starts line by line to each of the liquid crystal pixels 221 in the lower portion of the liquid crystal panel 220 which corresponds to the backlight 211*c*. The pulse signal PWM2 becomes inactive (level L) right before the time t2. That is, before the supplying to each of the liquid crystal pixels 221 of the lower portion of the liquid crystal panel 220 starts, the backlight drive circuit 600 extinguishes the backlight 221*c* corresponding to the lower portion of the liquid crystal panel 220. Then, until the time t4, the signal voltage is supplied to each of the liquid crystal pixels 221 of the lower portion of the liquid crystal panel 220.

Next, at the time t3, the pulse signal PWM0 rises as active (level H). That is, the backlight drive circuit 600 switches the backlight 221*a* corresponding to the upper portion of the liquid crystal panel 220 from off to on. Thereby, on the upper portion of the liquid crystal panel 220, an image corresponding to the signal voltage supplied right before (from the time t0 to t1) is displayed.

Then, until the time t5, the backlight drive circuit 600 keeps lighting the backlight 211*a*. Thereby, from the time t3 to right before the time t5, an image corresponding to the signal voltage supplied in the previous frame is displayed on the lower part of the liquid crystal panel 220.

Then, at the time t5, as the same as the time t0, the vertical sync signal STV rises, and then the operation described above is repeated. Thus, the period from the time t0 to t5 is a single frame period (one frame) of the liquid crystal panel 220.

Here, the period from the time t4 to t5 is a vertical blanking period (blank period), and the time t3 is the time after the vertical blanking period has passed since the time t2. Accordingly, the length of the lighting period of the backlight 211*a* (from t3 to t5), the length of the lighting period of the backlight 211*b* (from t0 to t1) and the length of the lighting period of the backlight 211*c* (from t1 to t2) are the same.

As such, the liquid crystal display device 200 to which the backlight drive circuit 600 of the embodiment is mounted extinguishes the backlight 211*a* before the signal voltage is supplied to the liquid crystal pixel groups of the upper portion of the liquid crystal panel 220 corresponding to the backlight 221*a* at the time t0 (=t5). Further, the backlight drive circuit 600 extinguishes the backlight 211*b* before the signal voltage is supplied to the liquid crystal pixel groups of the middle portion of the liquid crystal panel 220 corresponding to the backlight 221*b* at the time t1. Furthermore, the backlight drive circuit 600 extinguishes the backlight 211*c* before the signal voltage is supplied to the liquid crystal pixel groups of the lower portion of the liquid crystal panel 220 corresponding to the backlight 221*c* at the time t3.

Thereby, double-imaging at the time of resupplying of the signal voltage can be suppressed. Also, by extinguishing the corresponding backlights 211*a* to 211*c* during the response period of the liquid crystal pixels 221, motion blur during the response period of the liquid crystal pixels 221 can be suppressed.

Note that in the above description, the lighting period of each of the backlights 211*a* to 211*c* is not overlapped, but it is not limited thereto. For example, the lighting start time of each of the backlights 211*a* to 211*c* may be accelerated by accelerating the rise of each of the pulse signals PWM0 to PWM2 as shown as the broken line in FIG. 4.

Thereby, a longer lighting period of each of the backlights 211*a* to 211*c* within a single frame can be ensured, and the same luminance can be obtained even the current per unit time supplied to the backlights 211*a* to 211*c* is reduced. Here, in case of accelerating the rise of each of the pulse signals PWM0 to PWM1, the above-mentioned effect is exhibited by ensuring that the rise of the pulse signals PWM0 to PWM1 does not overlap with the supply period and the response period of the liquid crystal pixel groups corresponding to the pulse signals PWM0 to PWM1. That is, double-imaging during the response period of the liquid crystal pixels 221 and at the time of supplying of the signal voltage can be suppressed.

<1-3. Concrete Example of Amplitude of Drive Current and Duty Ratio>

A concrete example of the amplitude of the drive current and the duty ratio supplied to each of the backlights 211 by the backlight drive circuit 600 is described.

Figure 5:
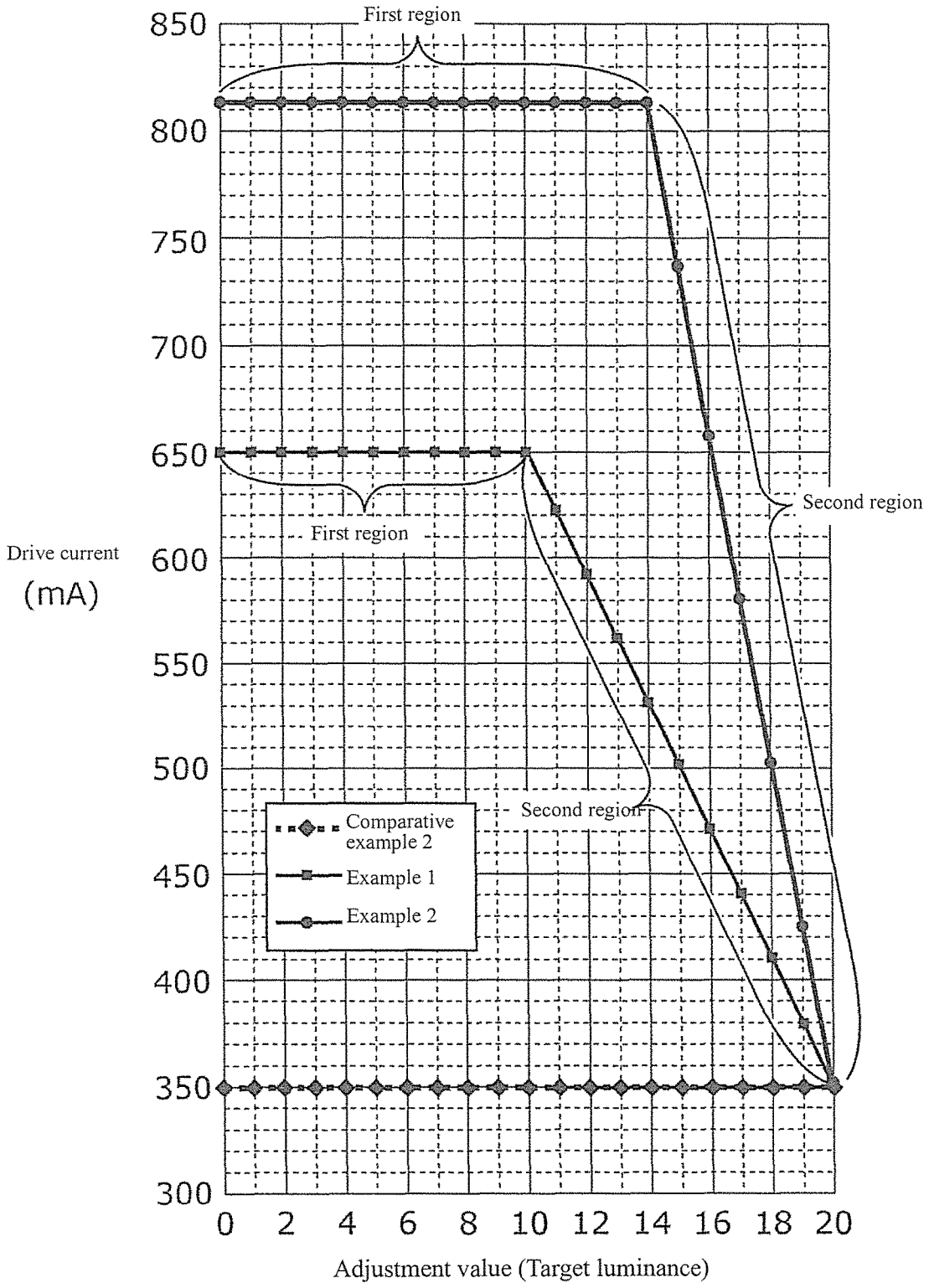
FIG. 5 is a graph illustrating the drive current during the lighting period of the backlights with respect to the adjustment values.

FIG. 5 is a graph illustrating an example of the amplitude characteristics of the drive current with respect to the target luminance (that is, the amount of the drive current supplied to the backlights 211 during the lighting period) in the comparative example 2 and the examples 1 and 2 of the first embodiment.

Figure 6:
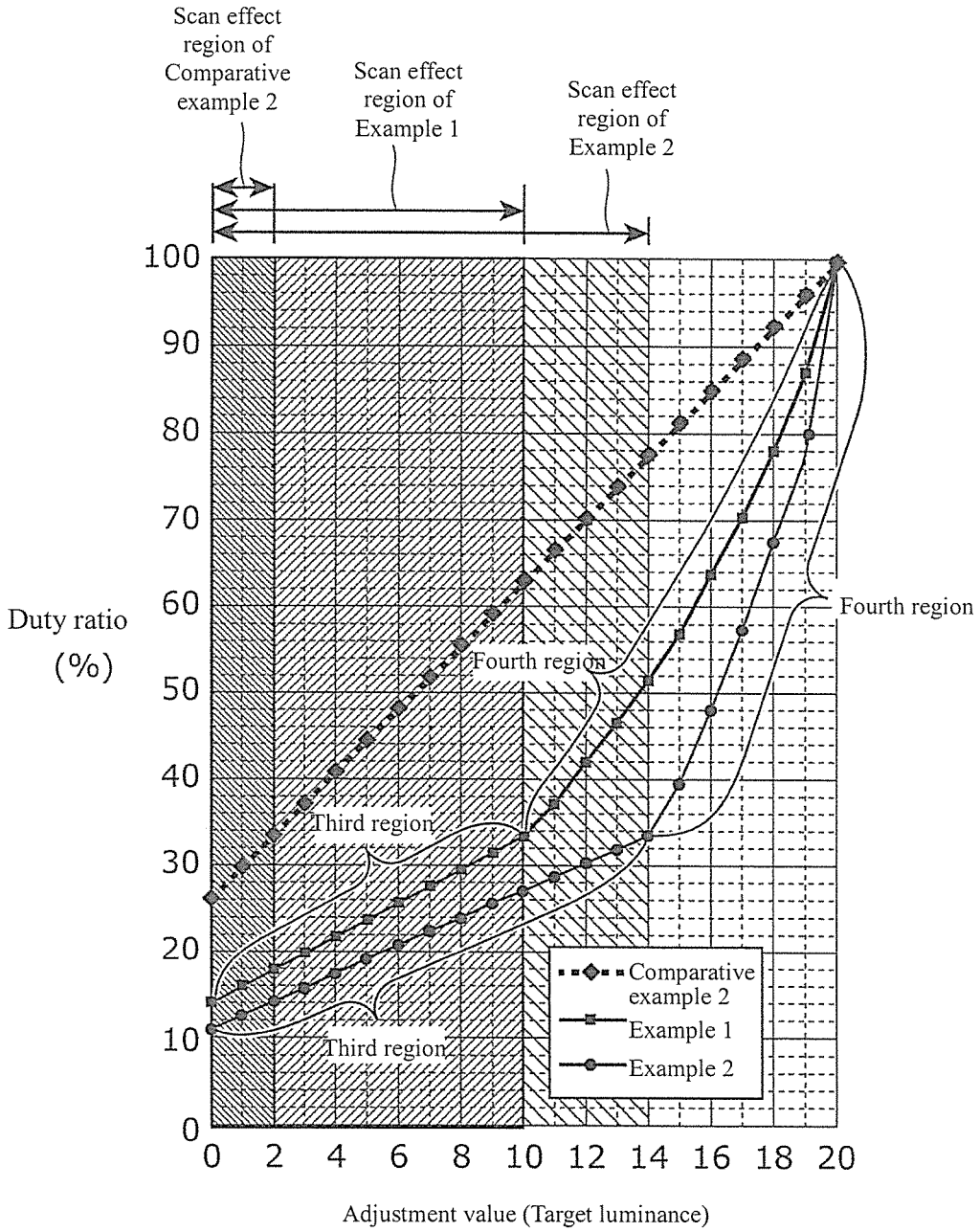
FIG. 6 is a graph illustrating the lighting duty ratio of the backlights with respect to the adjustment values.

FIG. 6 is a graph illustrating an example of the duty ratio characteristics of the drive current with respect to the target luminance (that is, the lighting duty ratio of the backlights 211) in the comparative example 2 and the examples 1 and 2 of the first embodiment. The duty ratio characteristics shown in FIG. 6 may be formed by points defining a straight line or a curved line.

The graphs of FIGS. 5 and 6 show combinations of the amplitude and the duty ratio of the drive current for lighting the backlights 211 at the approximately same luminance when the same target luminance is specified in the comparative example 2 and the examples 1 and 2 of the first embodiment.

The backlight drive circuit 600 outputs the drive current which is the drive signal of each of the backlights 211 according to, for example, the amplitude characteristics shown in FIG. 5 or the amplitude characteristics shown in FIG. 6.

As shown in FIG. 5, the amplitude of the drive current in the comparative example 2 is 350 [mA] and constant regardless of the target luminance.

On the other hand, the amplitude characteristics of the example 1 which boosts the drive current is divided with the predetermined luminance of 10 as the boundary, into the first region which is less than or equal to the predetermined luminance of 10 and the second region which is higher than the predetermined luminance of 10. In the first region, the change rate of the amplitude of the drive current with respect to the target luminance is equal to the predetermined change rate of 0, and in the second region, the change rate of the amplitude of the drive current with respect to the target luminance is greater than the predetermined change rate of 0. The first region and the second region of the above-mentioned characteristics are both indicated as a straight line, and the amplitude of the drive current is the first amplitude of 650 [mA], which is fixed regardless of the target luminance, in the first region.

Also, the amplitude characteristics of the example 2, which boosts the drive current, is divided with the predetermined luminance of 14 as the boundary, into the first region which is less than or equal to the predetermined luminance of 14, and the second region which is higher than the predetermined luminance of 14. In the first region, the change rate of the amplitude of the drive signal with respect to the target luminance is equal to the predetermined change rate of 0, and in the second region, the change rate of the amplitude of the drive signal with respect to the target luminance is greater than the predetermined change rate of 0. The first region and the second region of the above-mentioned characteristics are both indicated as a straight line, and the amplitude of the drive current is the first amplitude of 815 [mA], which is fixed regardless of the target luminance, in the first region.

In both the example 1 and the example 2, the amplitude of the drive current continuously changes as the target luminance changes. The amplitude of the drive current in the second region is the second amplitude, which becomes smaller as the target luminance is higher, and is 350 [mA] as the same as the comparative example 2 at the maximum value of the target luminance.

As such, the amplitude characteristics of both the example 1 and the example 2 are divided into the first region less than or equal to the predetermined luminance, and the second region higher than the predetermined luminance. The change rate of the amplitude of the drive signal with respect to the luminance in the first region is less than or equal to the predetermined change rate, and the change rate of the amplitude of the drive signal with respect to the luminance in the second region is greater than the predetermined change rate.

As shown in FIG. 6, the duty ratio of the drive current in the comparative example 2 changes with a constant inclination with respect to the target luminance.

On the other hand, the duty ratio characteristics of the example 1 is divided with the predetermined luminance of 10 as the boundary, into the third region which is less than or equal to the predetermined luminance of 10 and the fourth region which is higher than the predetermined luminance of 10. The change rate of the duty ratio of the drive signal with respect to the target luminance in the third region is smaller than the change rate of the duty ratio of the drive signal with respect to the target luminance in the fourth region.

Also, the duty ratio characteristics of the example 2 is divided with the predetermined luminance of 14 as the boundary, into the third region which is less than or equal to the predetermined luminance of 14 and the fourth region which is higher than the predetermined luminance of 14. The change rate of the duty ratio of the drive signal with respect to the target luminance in the third region is smaller than the change rate of the duty ratio of the drive signal with respect to the target luminance in the fourth region.

In the fourth region of the duty ratio characteristics of the example 1 and the example 2, the duty ratio of the drive current changes at a greater change rate than the change rate in the third region as the drive current is boosted in the second region of the respectively corresponding amplitude characteristics.

Therefore, in the examples 1 and 2, because a higher target luminance can be achieved with the same duty ratio compared to the comparative example 2 (in other words, the same target luminance can be achieved with a smaller duty ratio), the upper limit of the range of the target luminance with which the scan effect can be obtained (hereinafter, referred to as "scan effect region") is increased. Specifically, the scan effect region of the comparative example 2 is limited to the range of 0 to 2 of the target luminance, but the scan effect region in the example 1 is extended to the range of 0 to 10 of the target luminance by boosting the drive current. Moreover, the scan effect region in the example 2 is extended to the range of 0 to 14 of the target luminance by boosting the drive current greater than the example 1.

When considering the combinations of the amplitude and the duty ratio of the drive current, it is important that the maximum light emission luminance in the backlights 211 can be obtained corresponding to the maximum value of the target luminance and that the power loss occurred in the backlights 211 does not exceed the maximum allowable loss.

To satisfy such requirements, for example, the DC current the duty ratio of which is 100% corresponding to the maximum value of the target luminance and the amount of which is the amount of the maximum allowable loss occurred in the backlights 211 (for example, 350 [mA] shown in FIG. 5) may be supplied to the backlights 211 as the drive current. Thereby, the maximum light emission luminance can be obtained because the backlights 211 continuously emit light at the maximum rate corresponding to the maximum value of the target luminance.

Also, for example, in the examples 1 and 2 which boost the drive current, the power loss of the backlights 211 may be managed at the above-mentioned predetermined luminance. Specifically, when the target luminance is at the predetermined luminance, the current with the duty ratio with which the power loss smaller than the maximum allowable loss occurs in the backlights 211 may be supplied to the backlights 211 as the drive current. Thereby, it is possible to provide a margin regarding the power loss to the drive current at the predetermined luminance.

The drive current at the predetermined luminance has the maximum duty ratio among the drive current the amplitude of which is the first amplitude, and the margin regarding the power loss of the backlights 211 is minimum. Purposefully giving a margin regarding the power loss of the backlights 211 to such drive current is beneficial for, for example, managing the power loss not to exceed the maximum allowable loss under variable circuit characteristics and variable operation temperatures.

Also, as shown in FIGS. 5 and 6, to obtain the scan effect in the luminance region below the predetermined luminance (that is, the first region of the luminance characteristics and the third region of the duty ratio characteristics), the duty ratio of the drive signal at the predetermined luminance may be configured based on the response time of the display.

As mentioned earlier, the backlights 211 are built into a three-row constitution with the backlights 211*a*, 211*b* and 211*c*, and it is assumed that a single vertical scan period is Vs, the supply period of the signal voltage is (1/3) Vs, and the response period of the display is (1/3) Vs. In this case, double-imaging can be suppressed by setting the duty ratio at the predetermined luminance to 1/3 (≈33%) which is equal to the ratio of the period in which the transmittance of the display is stable over the vertical scan period, and by extinguishing the backlights when resupplying the signal voltage of the display and during the response period of the display.

More generally, a duty ratio below the ratio of the period in which the transmittance of all the liquid crystal pixels disposed in the partial region illuminated by the backlights of the display is stable (that is, the period in which the transmittance of the display becomes the transmittance indicated by the supplied signal voltage, and, for example, excluding the supply period for the signal voltage and the response period of the display) over a single vertical scan period is set as the duty ratio in the third region of the duty ratio characteristics. Then, the amplitude of the drive current which achieves the target luminance by the combination with the set duty ratio is set as the amplitude in the first region of the amplitude characteristics.

The amplitude of the drive current in the first region may be fixed to the first amplitude. Fixing the amplitude in the first region is not essential, but the following secondary effect is produced. Since the entire target luminance included in the scan effect region is achieved by the drive current with the first amplitude, which is fixed regardless of the target luminance, unnecessary deterioration of the luminous efficiency of the backlights can be avoided by increasing the amplitude of the drive current within the scan effect region.

Variation of First Embodiment

Next, the backlight drive circuit of a variation of the first embodiment is described.

The backlight drive circuit 600 of the first embodiment generates the pulse signals PWM0 to PWM2 corresponding to each of the backlight driver 130*a* to 130*c* by using the SOC 411 and the TCON 112, but the SOC may generate the pulse signal PWM0 to PWM2 without using the TCON 112.

Figure 7:
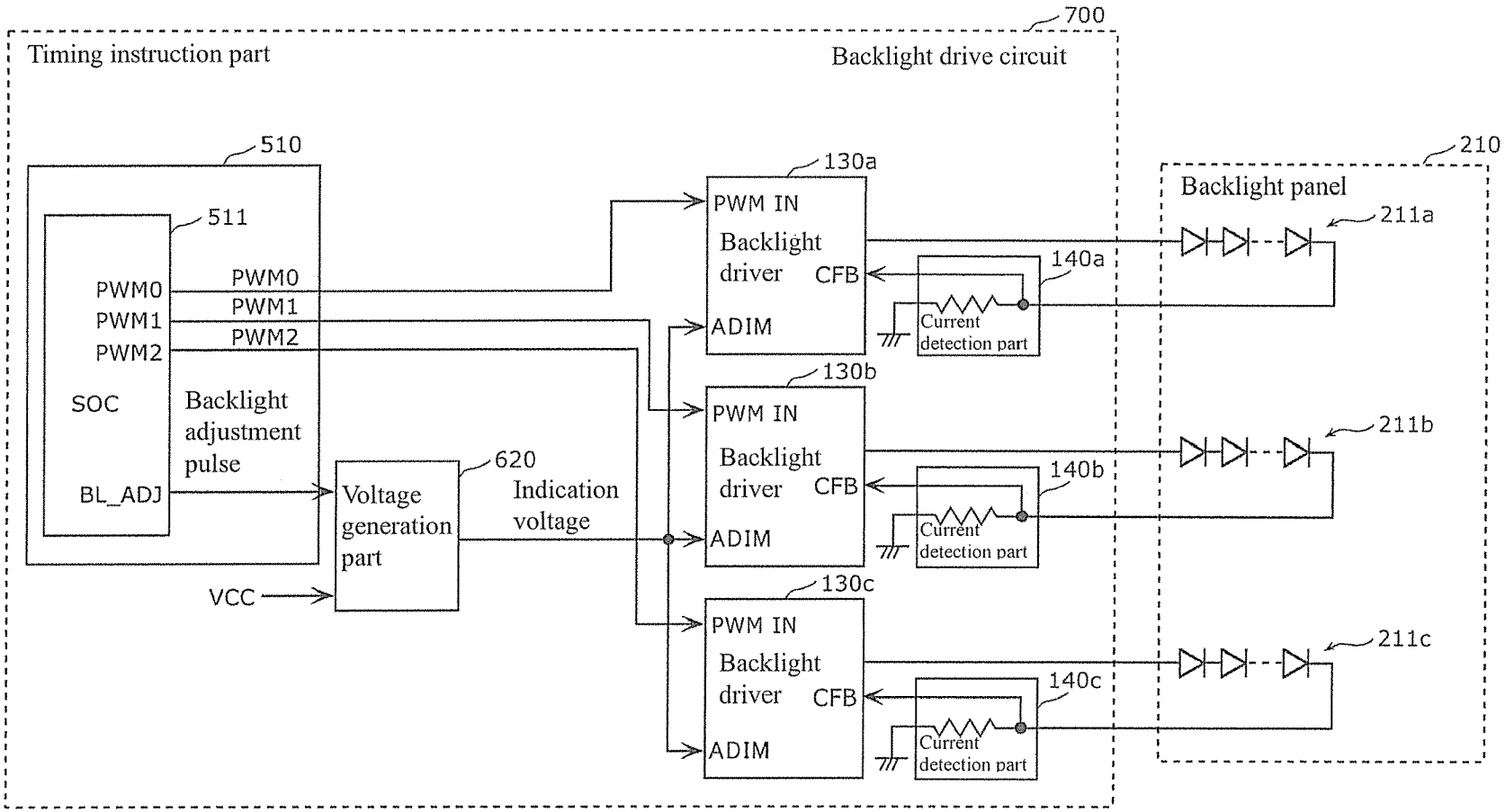
FIG. 7 is a block diagram illustrating the detailed constitution of a backlight drive circuit of a variation of the first embodiment.

FIG. 7 is a block diagram illustrating a detailed constitution of a backlight drive circuit 700 of a variation of the first embodiment.

The backlight drive circuit 700 shown in FIG. 7 differs from the backlight drive circuit 600 of the first embodiment in including an SOC instruction part 510 which includes an SOC 511 instead of the timing instruction part 410.

The SOC 511 has the functions of the SOC 411 and the TCON 112. That is, the SOC 511 generates the pulse signals PWM0 to PWM2 according to the target luminance and supplies the generated pulse signals PWM0 to PWM2 respectively to the backlight drivers 130*a* to 130*c*. The SOC 511 also generates backlight adjustment pulses which indicate the target luminance by the duty ratio of the pulse width modulation and supplies the generated backlight adjustment pulses to the voltage generation part 620.

With the backlight drive circuit 700 constituted as such, the same effect as of the backlight drive circuit 600 of the first embodiment can be obtained.

Second Embodiment

Next, a backlight drive circuit of the second embodiment is described.

In the backlight drive circuit 600 of the first embodiment, the backlight drivers 130*a* to 130*c* are constituted using the variable current regulator which generates the drive current of the amount of current indicated by the indication voltage. On the other hand, the backlight drivers of the second embodiment are constituted using a fixed current regulator. Here, the fixed current regulator refers to a circuit that adjusts the output current so that the measured amount of current of the output current becomes close to the predetermined fixed amount of current.

Figure 8:
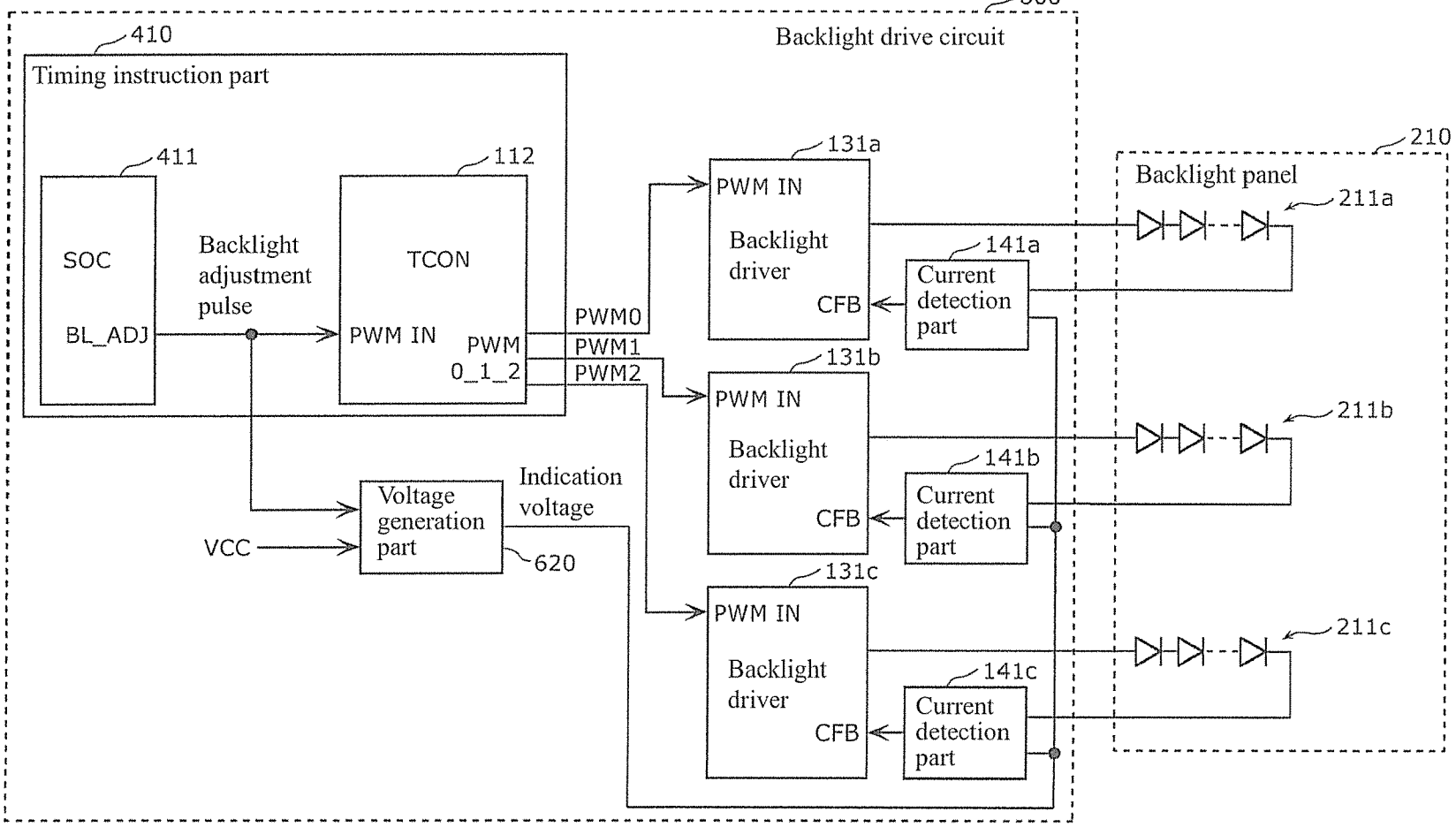
FIG. 8 is a block diagram illustrating the detailed constitution of a backlight drive circuit of the second embodiment.

FIG. 8 is a block diagram illustrating a detailed constitution of a backlight drive circuit 800 of the second embodiment.

The backlight drive circuit 800 shown in FIG. 8 differs from the backlight drive circuit 600 of the first embodiment in including backlight drivers 131*a* to 131*c* instead of the backlight drivers 130*a* to 130*c*, and in including current detection parts 141*a* to 141*c* instead of the current detection parts 140*a* to 140*c*.

The backlight drivers 131*a* to 131*c* are disposed so as to respectively correspond to the backlights 211*a* to 211*c*, and supply the drive current to the corresponding backlights 211*a* to 211*c*. Hereinafter, the backlight drivers 131*a* to 131*c* may be referred to as backlight drivers 131 without making any particular distinction among them.

The current detection parts 141*a* to 141*c* are sensors disposed so as to respectively correspond to the backlights 211*a* to 211*c*, and detect the amount of current of the drive current flowing into the corresponding backlights 211*a* to 211*c* and output feedback signals indicating an amount of current that is the detected amount of current subtracted by the amount of current corresponding to the indication voltage. Hereinafter, the current detection parts 141*a* to 141*c* may be referred to as current detection parts 141 without making any particular distinction among them.

Figure 9:
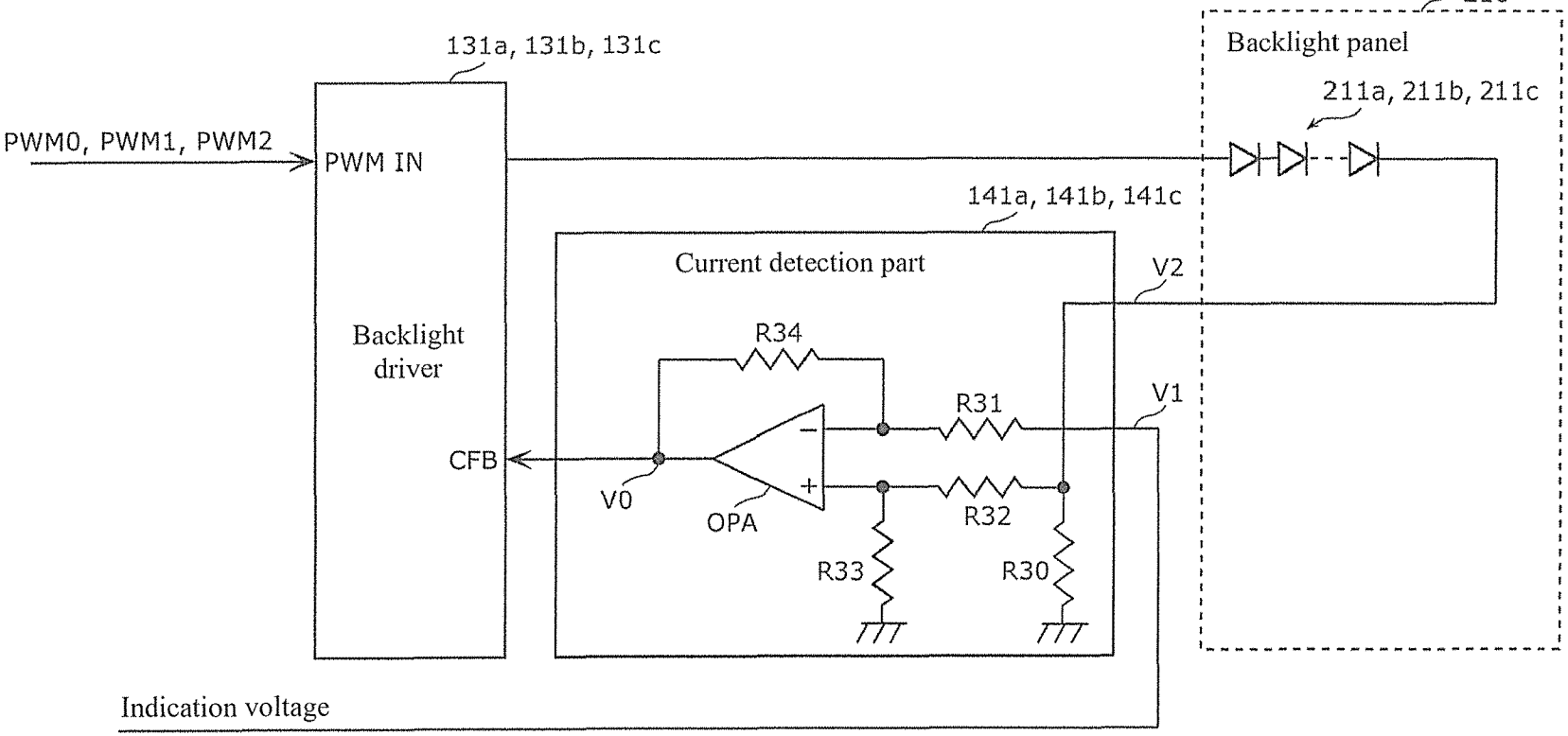
FIG. 9 is a circuit diagram illustrating an example of the detailed constitution of the current detection parts.

FIG. 9 is a circuit diagram illustrating an example of the detailed constitution of the current detection parts 141*a* to 141*c*. All the current detection parts 141*a* to 141*c* have the constitution shown in FIG. 9.

The current detection parts 141*a* to 141*c* have resistors R30 to R34 and an operational amplifier OPA.

The resistor R30 is a shunt resistor detecting the amount of current of the drive current flowing into the corresponding backlights 211*a* to 211*c*.

The resistors R30 to R34 and the operational amplifier OPA constitutes a subtracting circuit. Given that the indication voltage is notated as V1 and the voltage indicating the amount of current of the drive current detected by the resistor R30 is notated as V2, the subtracting circuit generates an output voltage $V0=((R31+R34)/(R31\times(R32/R33+1)))\times V2-(R34/R31)\times V1$. The output voltage V0 represents a corrected voltage that is obtained by subtracting the amount of current indicated by the indication voltage V1 from the actual amount of current of the drive current by the ratio determined according to the resistors R31 to R34.

The current detection parts 141*a* to 141*c* supply the generated output voltage V0 to the backlight drivers 131*a* to 131*c* as a feedback signal.

The description continues with referring to FIG. 8 again.

During the period in which the pulse signal provided by the TCON 112 is active, the backlight drives 131 supply the target amount of the drive current, with which the amount of current indicated by the feedback signal provided by the current detection parts 141 becomes equal to the predetermined fixed amount of current, to the backlights 211. During the period in which the pulse signal provided by the TCON 112 is inactive, the backlight drivers 131 stop supplying the drive current.

Specifically, the backlight drivers 131*a* to 131*c* generate the current which is pulse width modulated by applying chopper control to the target amount of the current according to the pulse signals PWM0 to PWM2, and supply the generated current to the backlights 211*a* to 211*c* as the drive current.

The backlight drivers 131*a* to 131*c* may be constituted with an IC (Integrated Circuit) having a fixed current regulator function and a current chopper function, for example.

According to the backlight drive circuit constituted 800 as such, the corrected amount of current smaller than the actual measured amount of the drive current is fed back to the backlight drivers 131 as the amount of current indicated by the indication voltage V1 is greater. As a result, the backlight drivers 131 boost the drive current with the magnitude according to the amount of current indicated by the indication voltage V1.

For example, in the backlight drivers 131, the amount of current indicating the unboosted normal amplitude of the drive current may be predefined as the fixed amount of current. The voltage generation part 620 may generate the indication voltage V1 which is 0 [V] when the target luminance is at maximum and is higher as the target luminance is smaller with the upper limit set to the voltage indicating the boosting amount of the drive current at the predetermined luminance. The resistance of the resistors R31 to R34 may be properly selected according to the needs for boosting the drive current with the desired level corresponding to the target luminance, and the level of the indication voltage V1 may be properly adjusted by using a level shifter or a voltage division circuit, which are not depicted.

According to the backlight drive circuit 800 constituted as such, the same effect as of the backlight drive circuit 600 of the first embodiment can be obtained using the fixed current regulator and the subtraction circuit instead of the variable current regulator.

Third Embodiment

In the backlight drive circuits of the first and second embodiments, the amplitude of the drive current is fixed to the first amplitude in the first region, but the amplitude characteristics of the drive current in with respect to the target luminance are not limited to such an example.

The third embodiment describes a backlight drive circuit that operates according to characteristics of the amplitude of the drive current with respect to the target luminance different from the aforementioned characteristics.

Such a backlight drive circuit is constituted, for example, by changing the voltage generation part 620 as follows.

Figure 10:
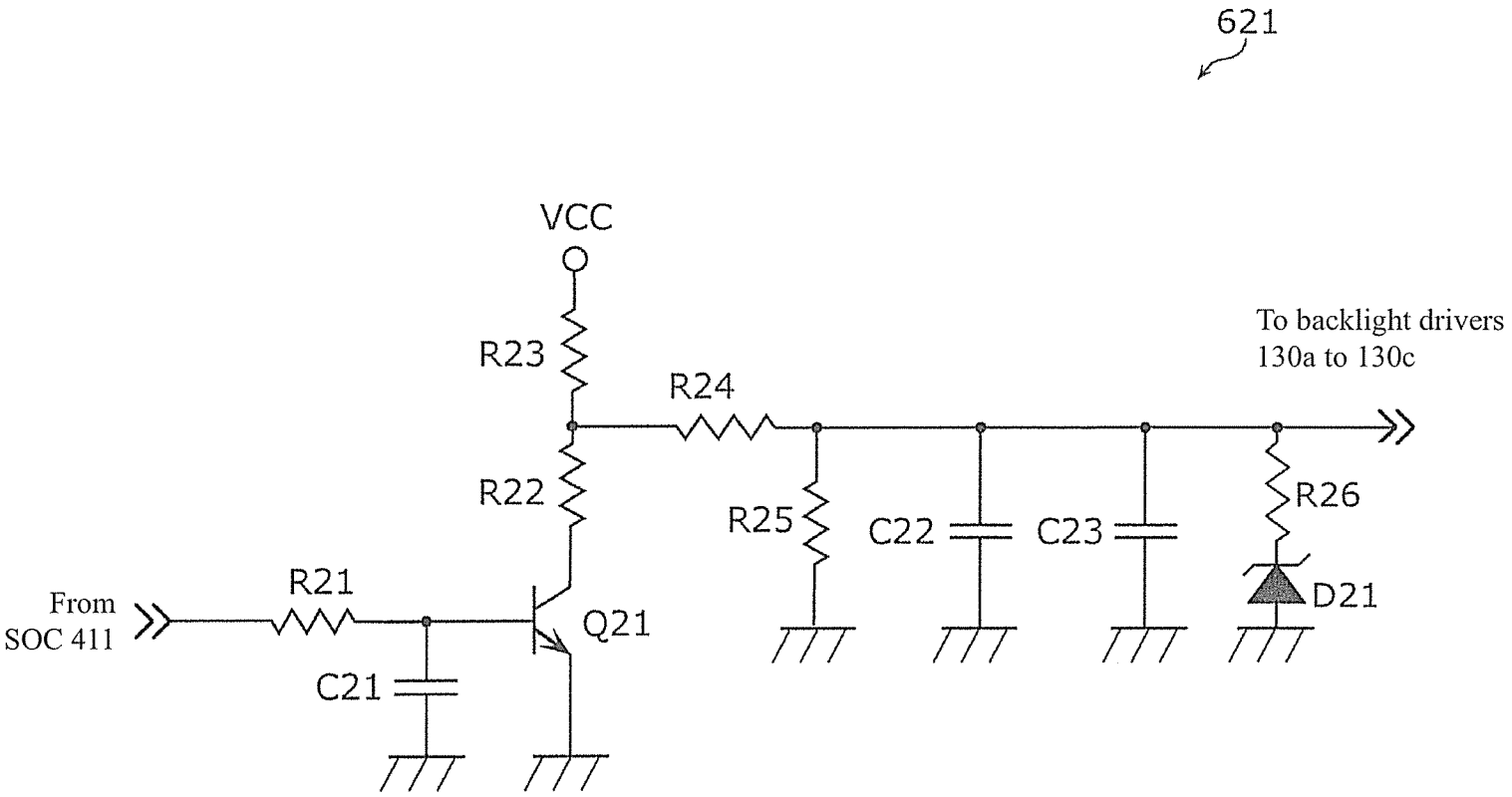
FIG. 10 is a circuit diagram illustrating an example of the detailed constitution of the voltage generation part of the third embodiment.

FIG. 10 is a circuit diagram illustrating an example of the detailed configuration of the voltage generation part. A voltage generation part 621 shown in FIG. 10 differs from the voltage generation part 620 shown in FIG. 3 in having an additional resistor R26 connected in series to the zener diode D21. The resistor R26 may be a resistive element inserted purposefully, or an equivalent resistive component such as wire, etc.

When the indication voltage supplied to the backlight drivers 130*a* to 130*c* by the voltage generation part 621 exceeds the breakdown voltage of the zener diode D21, the current flows into the resistor R26 and the voltage drop occurs. As a result, the voltage generation part 621 is different from the voltage generation part 620, such that the indication voltage increases to the voltage which is the sum of the voltage drop occurred at the resistor R26 and the breakdown voltage of the zener diode D21.

Figure 11:
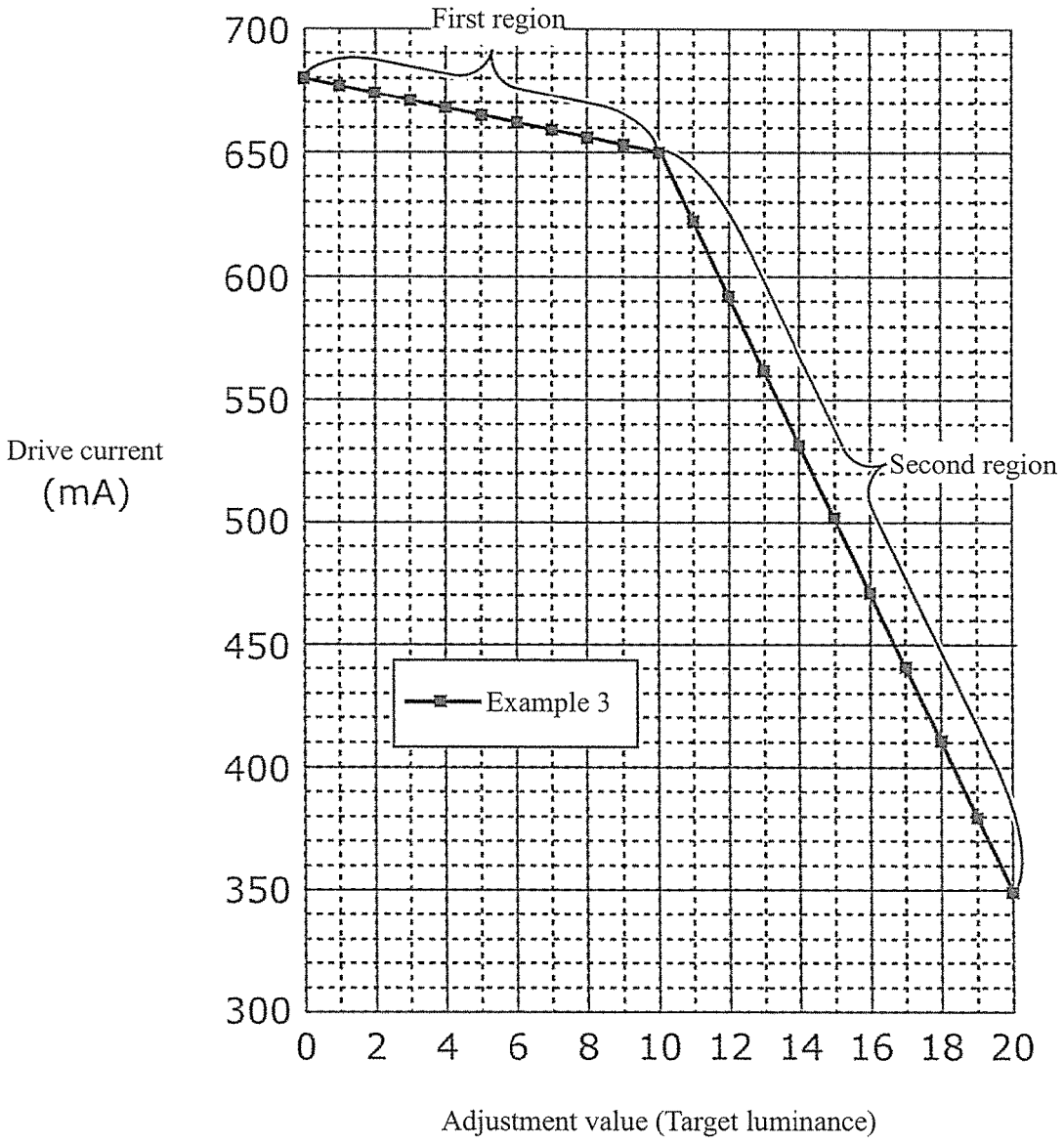
FIG. 11 is a graph illustrating the drive current during the lighting period of the backlights with respect to the adjustment values.

FIG. 11 is a graph illustrating an example of the amplitude of the drive current with respect to the target luminance indicated by the indication voltage generated by the voltage generation part 621, as the example 3.

As shown in FIG. 11, the amplitude characteristics of the drive current of the example 3 differs from the amplitude characteristics of the drive current of the example 1 shown in FIG. 5 in that the amplitude of the first region becomes the third amplitude, which is greater as the target luminance is lower.

The change of the third amplitude in the example 3 with respect to the target luminance is caused by the resistor R26 added to the voltage generation part 621. Thus, the change rate of the third amplitude with respect to the target luminance in the first region is set to the change rate which is smaller than the change rate of the second amplitude with respect to the target luminance in the second region and is in accordance with the level of the resistor R26.

According to such a constitution, since the change rate of the third amplitude with respect to the target luminance is smaller than the change rate of the second amplitude with respect to the target luminance, the expansion width of the amplitude of the drive current expanded by current boosting is decreased and, as a result, deterioration of the luminous efficiency of the backlights can be suppressed.

In the example 3, the first amplitude when the target luminance is the predetermined luminance is 650 [mA], which is equal to the first amplitude of the first embodiment, but the first amplitude may be less than 650 [mA]. It is possible to provide a greater margin regarding the power loss of the backlights 211 by smaller drive current at the predetermined luminance of the target luminance.

Further, another backlight drive circuit operating according to characteristics of the amplitude of the drive current with respect to the target luminance which are different from the aforementioned characteristics is described.

Such a backlight drive circuit is constituted by changing the current detection parts 141*a* to 141*c* in FIG. 9 as follows.

Figure 12:
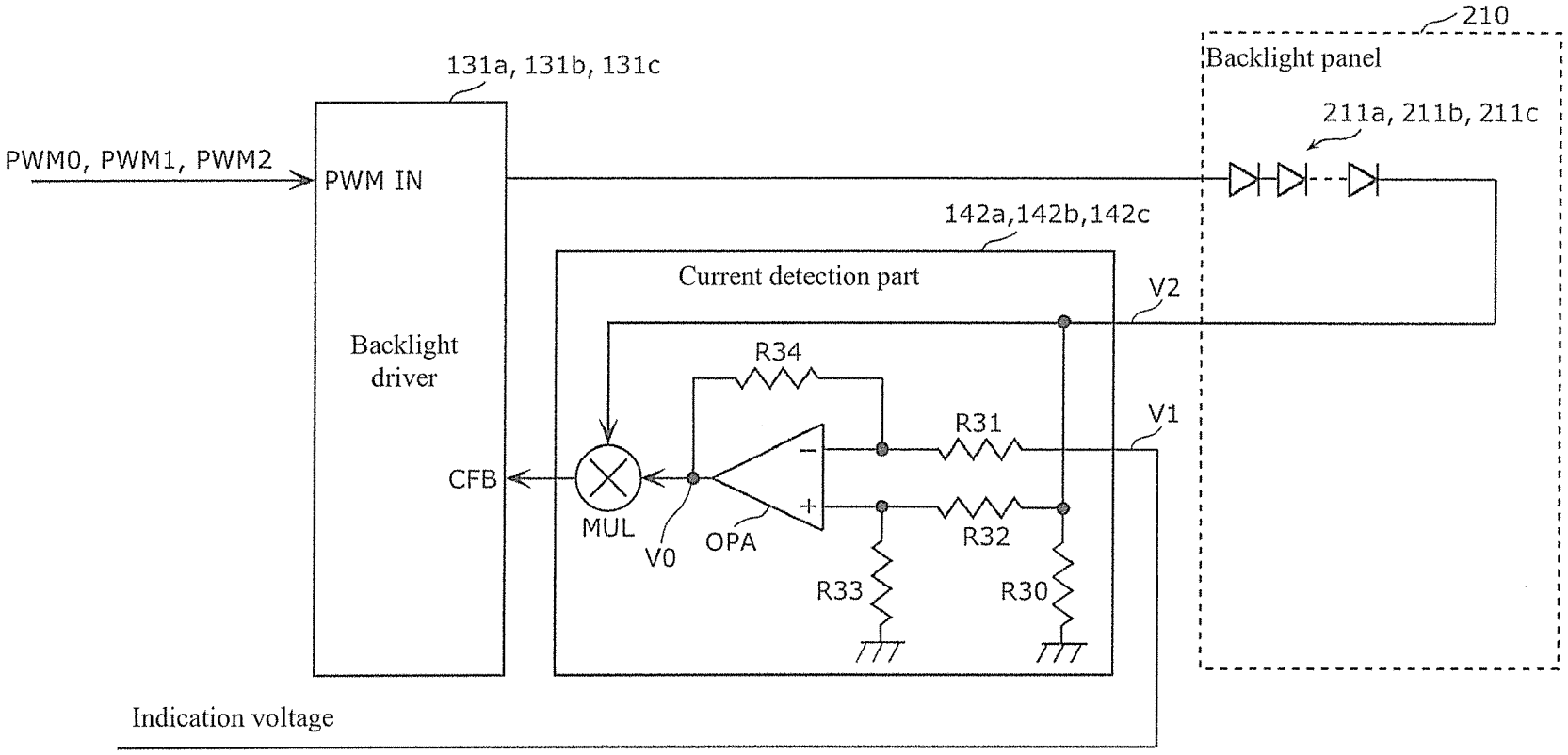
FIG. 12 is a circuit diagram illustrating an example of the detailed constitution of the current detection parts of the third embodiment.

FIG. 12 is a circuit diagram illustrating an example of detailed constitution of the current detection parts. In the current detection parts 142*a* to 142*c* shown in FIG. 12, a multiplier MUL is added compared to the current detection parts 141*a* to 141*c*. The current detection parts 142*a* to 142*c* generate an output voltage that is obtained by multiplying the output voltage V0 of the operational amplifier OPA by the voltage V2 indicating the amount of current of the drive current measured by the resistor R30, using the multiplier MUL.

Figure 13:
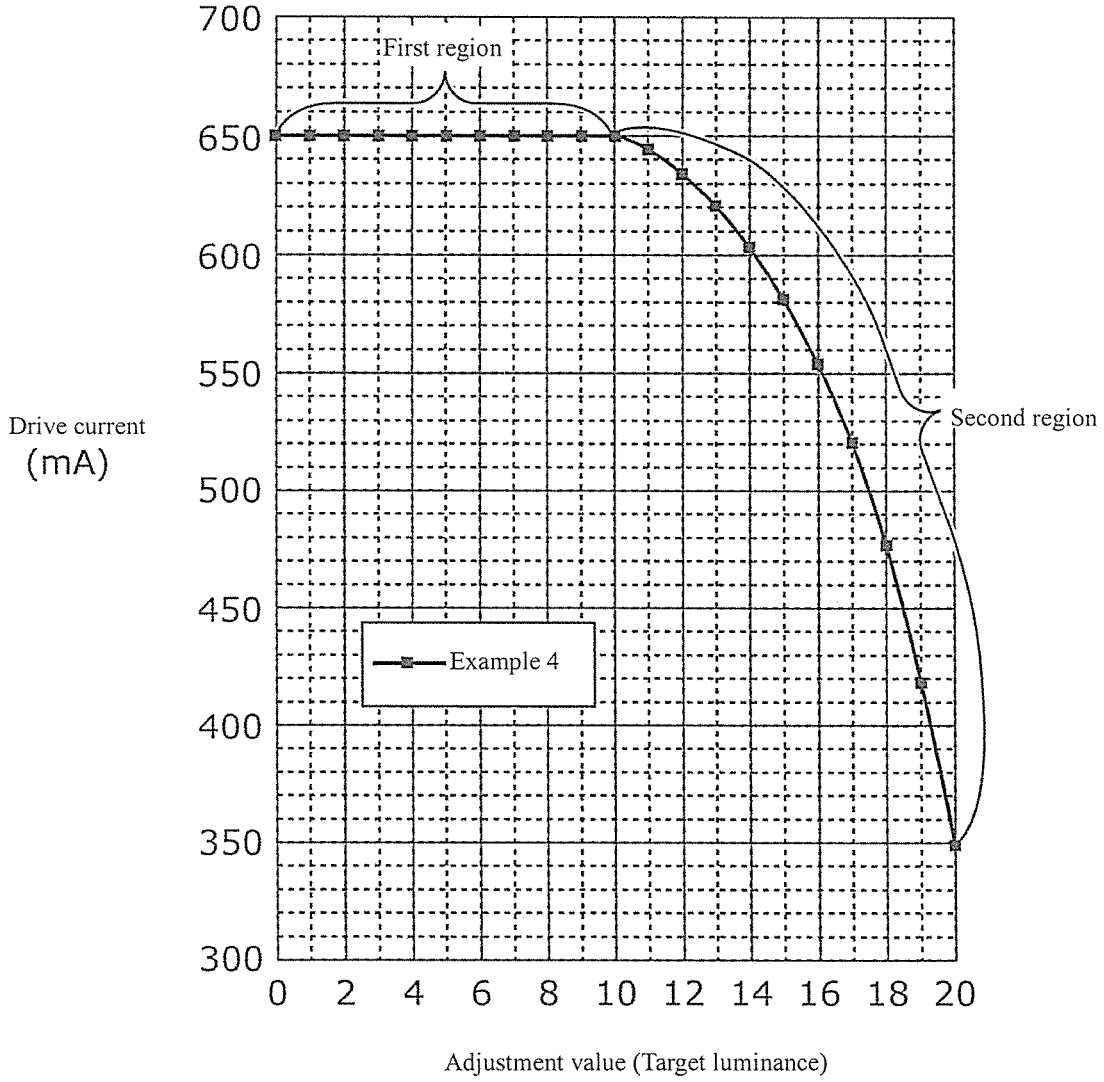
FIG. 13 is a graph illustrating the drive current during the lighting period of the backlights with respect to the adjustment values.

FIG. 13 is a graph illustrating an example of the amplitude of the drive current with respect to the target luminance which is controlled by the output voltage generated by the current detection parts 142*a* to 142*c*, as the example 4.

As shown in FIG. 13, the amplitude characteristics of the drive current of the example 4 differs from the amplitude characteristics of the drive current of the example 1 shown in FIG. 5 in that the second amplitude in the second region changes nonlinearly with respect to the target luminance (that is, the second region of the amplitude characteristics is indicated as a curved line).

The nonlinear change with respect to the target luminance of the second amplitude in the example 4 is caused by controlling the backlight drivers 131*a*, 131*b* and 131*c* using a voltage that is obtained by multiplying the voltage V0 by the voltage V2, using the multiplier MUL added to the current detection parts 142*a* to 142*c*.

According to such a constitution, since the change rate of the second amplitude with respect to the target luminance near the predetermined luminance can be made smaller compared to the first embodiment, flicker occurred because of the discontinuity of the amplitude of the drive current at the time of switching of the target luminance can be suppressed.

Further, in another backlight drive circuit, the voltage generation part 621 of FIG. 10 and the current detection parts 142*a* to 142*c* are combined.

Figure 14:
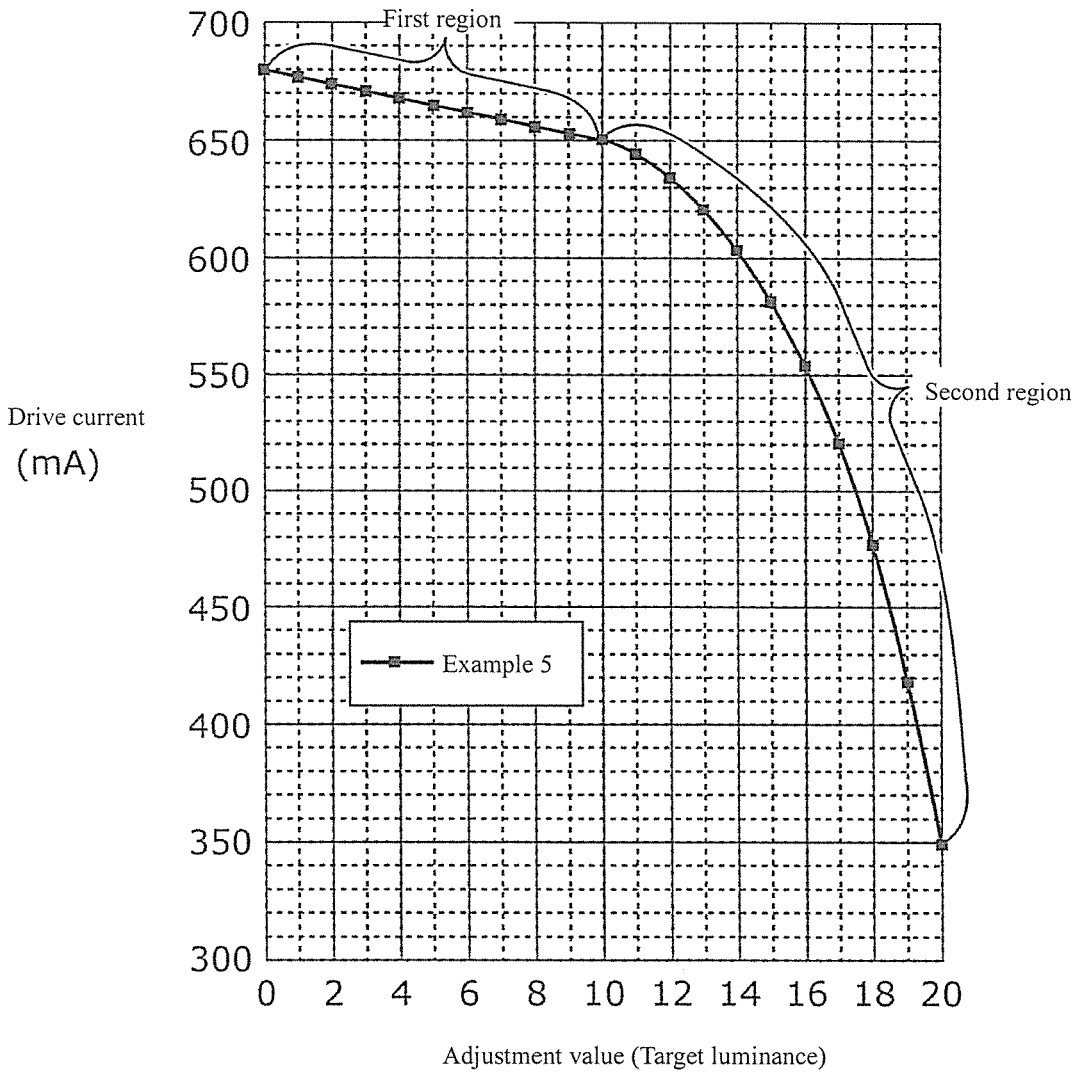
FIG. 14 is a graph illustrating the drive current during the lighting period of the backlights with respect to the adjustment values.

FIG. 14 is a graph illustrating an example of the amplitude of the drive current in such a backlight drive circuit, as the example 5.

As shown in FIG. 14, the amplitude characteristics of the drive current of the example 5 are that the characteristics regarding the third amplitude in the first region is the same as of the example 3, and the characteristics regarding the second amplitude in the second region is the same as of the example 4.

According to such a constitution, since the difference between the change rate of the second amplitude with respect to the target luminance and the change rate of the third amplitude with respect to the target luminance can be made further smaller near the predetermined luminance, flicker occurred because of the discontinuity of the amplitude of the drive current at the time of switching of the target luminance can be suppressed.

The backlight drive circuits of the embodiments are as described above, but the present invention is not limited thereto. Unless departing from the scope and spirit of the present invention, other modes to which variations those skilled in the art come up with are applied or modes which are constructed by combining components from different embodiments may be included in the scope of one or more embodiments of the present invention.

For example, the embodiments of the present invention describes an example in which the amplitude of the drive current in the first region of the amplitude characteristics is fixed to the first amplitude, which is fixed regardless of the target luminance, and another example in which the amplitude of the drive current is the third amplitude, which is greater as the target luminance is lower. However, the amplitude of the drive current may be smaller as the target luminance is lower in the first region of the amplitude characteristics.

According to such a constitution, since the amplitude of the drive current which is expanded by current boosting in the second region of the amplitude characteristics is reduced in the first region of the amplitude characteristics, deterioration of the luminous efficiency of the backlights is suppressed.

Also, in the embodiments of the present invention, for example, the first region of the amplitude characteristics is indicated as a straight line, but the first region of the amplitude characteristics may be indicated as a curved line.

INDUSTRIAL APPLICABILITY

The present invention can be applied to liquid crystal display device such as a television receiver, a smart phone, a tablet terminal, etc.

DESCRIPTION OF THE NUMERALS

112 TCON
130, 130*a*, 130*b*, 130*c*, 131, 131*a*, 131*b*, 131*c* Backlight driver
140, 140*a*, 140*b*, 140*c*, 141, 141*a*, 141*b*, 141*c* Current detection part
200 Liquid crystal display device (display device)
210 Backlight panel
211, 211*a*, 211*b*, 211*c* Backlight
220 Liquid crystal panel (display)
221 Liquid crystal pixels
410, 510 Timing instruction part
411, 511 SOC
620 Voltage generation part
600, 700, 800 Backlight drive circuit (light source drive part)
C21-C23 Capacitor
D21 Zener diode
Q21 Transistor
R21-R26, R30-R34 Resistor

The invention claimed is:

1. A display device comprising:
a display;
a light source; and
a controller that controls output of a drive current to the light source based on duty ratio characteristics and amplitude characteristics corresponding to a luminance of the light source,
wherein the amplitude characteristics are divided with a predetermined luminance of the light source as a boundary, into a first region that is less than or equal to the predetermined luminance, and a second region that is higher than the predetermined luminance, and
a change rate of, an amplitude of the drive current with respect to the luminance of the light source is less than or equal to a predetermined change rate in the first region, and a change rate of the amplitude of the drive current in the second region differs from a change rate of the amplitude of the drive current in the first region, wherein the change rate of the amplitude of the drive current in the second region gradually increases as the luminance of the light source increases.

2. The display device according to claim 1, wherein
the first region of the amplitude characteristics is indicated as a straight line or a curved line.

3. The display device according to claim 1, wherein
the change rate of the amplitude of the drive current with respect to the luminance of the light source is greater than the predetermined change rate in the second region of the amplitude characteristics.

4. The display device according to claim 1, wherein
the second region of the amplitude characteristics is indicated as a straight line or a curved line.

5. The display device according to claim 1, wherein
a range of a luminance of the first region is greater than or equal to a range of a luminance of the second region.

6. The display device according to claim 1, wherein
in the first region, the amplitude of the drive current with respect to a first luminance of the light source is greater than the amplitude of the drive current with respect to a second luminance that is higher than the first luminance.

7. The display device according to claim 1, wherein
in the first region, the amplitude of the drive current with respect to a first luminance of the light source is substantially equal to the amplitude of the drive current with respect to a second luminance that is higher than the first luminance.

8. The display device according to claim 1, wherein
in the second region, the amplitude of the drive current with respect to a third luminance of the light source is greater than the amplitude of the drive current with respect to a fourth luminance that is higher than the third luminance.

9. The display device according to claim 1, wherein the duty ratio characteristics indicate a greater duty ratio as the luminance of the light source is higher.

10. The display device according to of claim 1, wherein the duty ratio characteristics are divided with the predetermined luminance as a boundary, into a third region that is less than or equal to the predetermined luminance, and a fourth region that is higher than the predetermined luminance, and a change rate of the duty ratio of the drive current with respect to the luminance of the light source in the third region is smaller than a change rate of the duty ratio of the drive current with respect to the luminance of the light source in the fourth region.

11. The display device according to claim 10, wherein in the third region, the duty ratio of the drive current with respect to a fifth luminance of the light source is smaller than the duty ratio of the drive current with respect to a sixth luminance that is higher than the fifth luminance.

12. The display device according to claim 10, wherein in the fourth region, the duty ratio of the drive current with respect to a seventh luminance of the light source is smaller than the duty ratio of the drive current with respect to an eighth luminance that is higher than the seventh luminance.

13. The display device according to claim 1, wherein the duty ratio of the drive current at the predetermined luminance is configured based on a response speed of the display.

14. The display device according to claim 13, wherein the duty ratio of the drive current at the predetermined luminance is substantially equal to a ratio of a period in which a transmittance of the display is at a predetermined transmittance over a vertical scan period.

15. A display device that drives a light source based on amplitude characteristics that are divided with a predetermined luminance as a boundary, into a first region that is less than or equal to the predetermined luminance, and a second region that is higher than the predetermined luminance, wherein the amplitude characteristic in the first region is indicated as a straight line or a curved line, and the amplitude characteristic in the second region is indicated as a curved line that has a different change rate from the first region, wherein the amplitude characteristic corresponds to a drive current of the light source, wherein the change rate of the amplitude of the drive current in the second region gradually increases as the luminance of the light source increases.

16. The display device according to claim 15, wherein a range of a luminance in the first region is greater than or equal to a range of a luminance in the second region.

17. The display device according to claim 15, wherein in the first region, the amplitude of the drive current with respect to a first luminance of the light source is greater than the amplitude of the drive current with respect to a second luminance that is higher than the first luminance.

18. The display device according to claim 15, wherein in the first region, the amplitude of the drive current with respect to a first luminance of the light source is substantially equal to the amplitude of the drive current with respect to a second luminance that is higher than the first luminance.

19. The display device according to claim 15, wherein in the second region, the amplitude of the drive current with respect to a third luminance of the light source is greater than the amplitude of the drive current with respect to a fourth luminance that is higher than the third luminance.

20. The display device according to claim 15, wherein the light source is, further, driven based on a duty ratio characteristics, and the duty ratio characteristics is divided with the predetermined luminance as a boundary, into a third region that is less than or equal to the predetermined luminance, and a fourth region that is higher than the predetermined luminance wherein the duty ratio characteristic in the third region is indicated as a straight line or a curved line, and the duty ratio characteristic in the fourth region is indicated as a straight line or a curved line that has a greater change rate than the third region.

21. The display device according to claim 20, wherein in the third region, the duty ratio of the drive current with respect to a fifth luminance is smaller than the duty ratio of the drive current with respect to a sixth luminance that is higher than the fifth luminance.

22. The display device according to claim 20, wherein in the fourth region, the duty ratio of the drive current with respect to a seventh luminance is smaller than the duty ratio of the drive current with respect to an eighth luminance that is higher than the seventh luminance.

23. The display device according to claim 20, wherein the duty ratio of the drive current at the predetermined luminance is configured based on a response speed of the display.

* * * * *